US006434947B2

(12) United States Patent
Zhu et al.

(10) Patent No.: US 6,434,947 B2
(45) Date of Patent: Aug. 20, 2002

(54) PULSE TUBE REFRIGERATOR

(75) Inventors: Shaowei Zhu, Kariya; Masahumi Nogawa, Toyota; Shin Kawano, Kariya; Tatsuo Inoue, Anjo, all of (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/822,354

(22) Filed: Apr. 2, 2001

(30) Foreign Application Priority Data

Mar. 31, 2000 (JP) ..... 2000-097757

(51) Int. Cl.[7] ..... F25B 9/00; F25B 29/10
(52) U.S. Cl. ..... 62/6; 60/520
(58) Field of Search ..... 62/6; 60/520

(56) References Cited

U.S. PATENT DOCUMENTS 5,412,952 A * 5/1995 Ohtani et al. ..... 62/6
5,481,878 A 1/1996 Shaowei
5,689,959 A * 11/1997 Yatsuzuka et al. ..... 62/6
5,711,157 A * 1/1998 Ohtani et al. ..... 62/6
5,904,046 A * 5/1999 Kawano ..... 62/6
5,974,807 A * 11/1999 Gao et al. ..... 62/6
6,256,998 B1 * 7/2001 Gao ..... 62/6

FOREIGN PATENT DOCUMENTS

JP 4-151467 5/1992
JP 10-148410 6/1998

* cited by examiner

*Primary Examiner*—William C. Doerrler
(74) *Attorney, Agent, or Firm*—Oblon, Spivak, McClelland, Maier & Neustadt, P.C.

(57) ABSTRACT

In a pulse tube refrigerator the refrigeration efficiency has been improved by reducing the on-off valve loss. A second space 47 in a cylinder member 41 is connected with a second high pressure on-off valve 23 and a second low pressure on-off valve 24. A buffer side on-off valve 25 is provided between the buffer space (a buffer tank 50) and the second space 47. By opening the buffer side on-off valve 25 before the second high pressure on-off valve 23 or the second low pressure on-off valve 24 is open, the pressure in the second space 47 can be the intermediate pressure. Since the pressure difference when the valves are open is decreased, the on-off valve loss can be decreased.

12 Claims, 12 Drawing Sheets

Prior Art

Prior Art

PULSE TUBE REFRIGERATOR

CROSS REFERENCE TO RELATED APPLICATIONS

The present application is based on Japanese Patent Application no. 2000-097757, filed on Mar. 31, 2000, which is hereby incorporated by reference in its entirety.

BACKGROUND OF THE INVENTION

1. Field of the Invention

This invention relates to a pulse tube refrigerator.

2. Description of the Background

In recent years, various structures for a pulse tube refrigerator are proposed. One is a four valve type pulse tube refrigerator is shown in FIG. 11. In FIG. 11 a four valve type pulse tube refrigerator 201 includes a compressor 10, a first high pressure on-off valve 21 and a second high pressure on-off valve 23 connected with a high pressure outlet port 10*a* of the compressor 10, a first low pressure on-off valve 22 and a second low pressure on-off valve 24 connected with a low pressure inlet port 10*b* of the compressor 10. A cryocooler 30 includes a regenerator 31, a cold head 32, a pulse tube 33 and a radiator 34 arranged in series in line. A hot end 31*b* of the regenerator 31 is connected with the first high pressure on-off valve 21 and the first low pressure on-off valve 22. A hot end 33*b* of the pulse tube 33 is connected with the second high pressure on-off valve 23 and the second low pressure on-off valve 24. Since the high pressure operating gas flows not only from the hot end 31*b* of the regenerator 31 but also from the hot end 33*b* of the pulse tube 33, the displacement of the operating gas in the pulse tube 33 is restricted, and the heat invasion from the hot end 33*b* of the pulse tube 33 into the cold head 32, which increases in accordance with the increase of the displacement of the operating gas in the pulse tube 33, can be restricted. Accordingly, a refrigeration efficiency is improved in comparison to a orifice buffer type pulse tube refrigerator.

The above four valve type pulse tube refrigerator with a high refrigerator efficiency still has a drawback: a generation of an unnecessary fluid return (DC flow). Since the hot end 33*b* of the pulse tube 33 is connected with the second high pressure on-off valve 23 and the second low pressure on-off valve 24, and the hot end 31*b* of the regenerator 31 is connected with the first high pressure on-off valve 21 and the first low pressure on-off valve 22, the compressor 10 and the cryocooler 30 form a closed circuit through each on-off valve. As a consequence, the operating gas circulates in the closed circuit independently of the cooling cycle. Due to the operating gas, the heat of the relativcly high temperature portion is transmitted into the cryocooler 30, and the refrigeration efficiency is decreased.

DC flow (Direct Current flow) is of two types, according to the direction of the flow. One of the DC flows is from the high pressure outlet port 10*a* of the compressor 10 through the first high pressure on-off valve 21 into the cryocooler 30 from the regenerator 31 side, and further from the hot end 33*b* of the pulse tube 33 through the second low pressure on-off valve 24, and returns to the low pressure inlet port 10*b* of the compressor 10. The other DC flows is from the high pressure outlet port 10*a* of the compressor 10 through the second high pressure on-off valve 23 into the cryocooler 30 from the pulse tube 33 side, and further from the hot end 31*b* of the regenerator 31 through the first low pressure on-off valve 22, and returns to the low pressure inlet port 10*b* of the compressor 10. The flow direction is determined depending on the operating condition of the pulse tube refrigerator. Both flows cause a decrease of the refrigeration efficiency due to the heat conduction by the DC flow. As a consequence, even in the four valve type pulse tube refrigerator, the improvement of the refrigeration efficiency is limited.

To solve the above explained drawbacks of the DC flow, an improved four valve type pulse tube refrigerator as shown in FIG. 12 has been proposed. A pulse tube refrigerator 202 includes the structure of the four valve type pulse tube refrigerator 201 as shown in FIG. 11, and also includes a fluid shield 40 connected with the pulse tube 33 (the radiator 34) at one end and connected with the second high pressure on-off valve 23 and the second low pressure on-off valve 24 at the other end. The fluid shield 40 is provided with a cylinder member 41 and a piston 42 slidably disposed in the cylinder member 41. The piston 42, and a piston ring 43 attached on the outer periphery of the piston 42, separate the interior of the cylinder member 41 into a first space 46 connected with the inner space of the pulse tube 33 and a second space 47 connected with the second high pressure on-off valve 23 and the second low pressure on-off valve 24. According to this structure, generation of the DC flow is interrupted by the piston 42 and the piston ring 43. Since the heat is not conducted by the DC flow, the refrigeration efficiency can be improved.

Even the above explained improved four valve type pulse tube refrigerator has a problem relative to refrigeration efficiency: an on-off valve loss. In the pulse tube refrigerator 202 shown in FIG. 12, before each valve is opened, a maximum pressure difference is generated in the spaces of both sides of the on-off valves. For instance, the second high pressure on-off valve 23 is positioned between the second space 47 and the high pressure space of the high pressure outlet port 10*a* side of the compressor 10. Immediately before the second high pressure on-off valve 23 is open, the second space 47 is under a minimum pressure condition. The second low pressure on-off valve 24 is positioned between the second space 47 and the low pressure space of the low pressure inlet port 10*b* side of the compressor 10. Immediately before the second low pressure on-off valve is opened, the second spaces 47 is under a maximum pressure condition. If each valve opens in this condition, energy loss is generated by the momentary occurrence of a no pressure differential condition. The larger the pressure difference is, the higher the energy loss becomes. Therefore, even in the improved four valve type pulse tube refrigerator, the improvement of the refrigeration efficiency is still limited.

SUMMARY OF THE INVENTION

It is, therefore, an object of the present invention to overcome the above drawbacks of the conventional refrigerator.

It is another object of the present invention to improve refrigeration efficiency by decreasing an on-off valve loss in an improved four valve typed pulse tube refrigerator.

In order to achieve the above and other objects, the pulse tube refrigerator according to this invention includes a compressor, a first high pressure on-off valve and a second high pressure on-off valve connected with a high pressure outlet port of the compressor, a first low pressure on-off valve and a second low pressure on-off valve connected with the low pressure inlet port of the compressor, a cryocooler comprising a regenerator, a cold head and a pulse tube arranged in series in line and connected with the first high pressure on-off valve and the first low pressure on-off valve in the regenerator, a cylinder member connected with the pulse tube at one end, and connected with the second high pressure on-off valve and the second low pressure on-off valve at the other end, a piston slidably disposed in the cylinder member and separating the interior of the cylinder into a first space connected with the inner space of the pulse tube and a second space connected with the second high pressure on-off valve and with the second low pressure on-off valve, a buffer space connected with the second space of the cylinder member and a buffer side on-off valve provided between the buffer space and the second space.

It is a preferable feature of the invention to provide the buffer space in the pulse tube refrigerator. This buffer space is connected with the second space connected with the second high pressure on-off valve and with the second low pressure on-off valve. The buffer side on-off valve is provided between the buffer space and the second space of the cylinder member. Accordingly, if the pressure condition in the second space is a low pressure condition, and the pressure in the second space increases to reach the same pressure as in the buffer by opening the buffer side on-off valve. If the pressure condition in the second space is a high pressure condition, the pressure in the second space decreases to reach the same pressure as in the buffer by opening the buffer side on-off valve. Provided that the pressure in the buffer space is an intermediate pressure between the high pressure (the pressure in the high pressure outlet port side of the compressor) and the low pressure (the pressure in the low pressure inlet port side of the compressor), the pressure in the second space becomes the intermediate pressure by opening the buffer side on-off valve. After the pressure in the second space reaches the intermediate pressure, the pressure in the second space becomes the high pressure by opening the second high pressure on-off valve, and the pressure in the second space becomes the low pressure by opening the second low pressure on-off valve. In this case, the pressure difference when the second high pressure on-off valve is open is the high pressure subtracted by the intermediate pressure. The pressure difference when the second low pressure on-off valve is open is the intermediate pressure minus the low pressure, whereas conventionally the second high pressure on-off valve is opened suddenly while the pressure in the second space is low, and the second low pressure on-off valve is opened suddenly while the pressure in the second space is high. Accordingly, the pressure difference, when the second high pressure on-off valve and the second low pressure on-off valve are open, is the high pressure minus the low pressure. Therefore, the pressure difference, when the second high pressure on-off valve and the second low pressure on-off valve are open according to the invention, can be decreased. Accordingly, the refrigeration efficiency has been improved by reducing the on-off valve loss.

It is another feature of the invention to provide a plurality of buffer spaces provided and connected with the second space having a plurality of buffer side on-off valves therebetween, respectively. Accordingly, the pressure in each buffer space can be supplied variably in accordance with the desired operation.

By controlling each buffer side on-off valve to increase or decrease the pressure in the second space gradually, and afterward by operating the second high pressure on-off valve or the second low pressure on-off valve to open, the pressure difference when the second high pressure on-off valve and the second-low pressure on-off valve are opened can be decreased. Accordingly, the refrigeration efficiency has been further improved by reducing the on-off valve loss.

It is another preferable feature of the invention to include the cryocooler including a first cryocooler comprising a first regenerator, a first cold head and a first pulse tube arranged in series in line, and the first regenerator being connected with the first high pressure on-off valve and the first low pressure on-off valve, and a second cryocooler comprising a second regenerator, a second cold head and a second pulse tube arranged in series in line, and the first cold head being connected with the second regenerator. Since the first cold head in the first cryocooler is connected with the second regenerator in the second cryocooler, the second cryocooler can utilize the refrigeration generated in the first cryocooler. Accordingly, in the second cryocooler, extremely low temperature of 4K (liquefied helium temperature), for instance, can be generated.

It is another feature of the invention to provide the piston separating the interior of the cylinder member into a first space connected with the inner space of the pulse tube and a second space connected with the second high pressure on-off valve and with the second low pressure on-off valve, and a third space connected with the second regenerator. Accordingly, the interior of the cylinder member is divided into three spaces. By providing the third space, the operation heat normally emitted as waste heat according to the movement of the piston can be returned to the regenerator side. Since the work of the compressor is decreased, the refrigeration efficiency can be improved.

It is still another feature of the invention to provide the piston elastically supported by an elastic element, such as a spring, in the cylinder. Accordingly, the piston can stably reciprocate within the cylinder. Rubber or another element can be substituted for the spring as an elastic element.

Any mechanical element, fluid element or magnetic element can be used as the elastic element for supporting the piston in the cylinder. An actuator may be adopted as the mechanical element. An operating gas in the cylinder may be adopted as the fluid element. As the magnetic element, a magnetic material piston and a coil wound around the cylinder may be used to energize the coil to generate electromagnetic induction for driving the piston.

BRIEF DESCRIPTION OF THE DRAWINGS

A more complete appreciation of the invention and other advantages thereof will be readily obtained as the same becomes better understood by reference to the following detailed description when considered in connection with the accompanying drawings, wherein.

DETAILED DESCRIPTION OF THE PREFERRED EMBODIMENTS

Referring now to the embodiments of the present invention with reference to the attached-drawings:

First Embodiment

Figure 1:
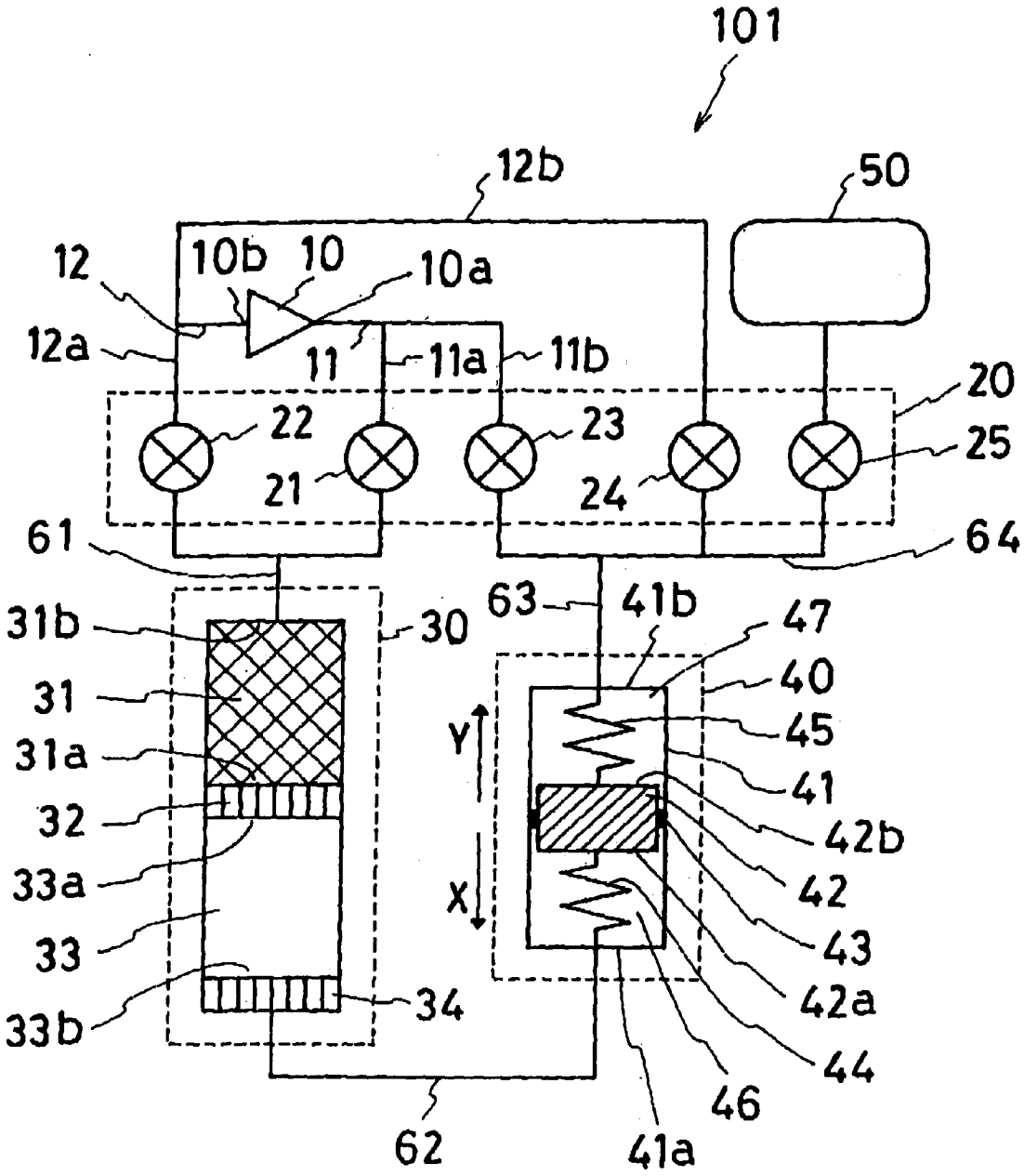
FIG. 1 is a schematic illustration of a pulse tube refrigerator of a first embodiment of the present invention.

FIG. 1 is a whole schematic illustration of a pulse tube refrigerator of the first embodiment of the invention. In the drawings, a pulse tube refrigerator 101 includes a compressor 10, a valve unit 20 connected with the compressor 10, a cryocooler 30 connected with the valve unit 20, a fluid shield 40 and a buffer tank 50.

The compressor 10 having a high pressure outlet port 10*a* and a low pressure inlet port 10*b* generates a pressure difference of an operating gas (helium gas in this embodiment). A high pressure operating gas flows to the high pressure outlet port 10*a* and a low pressure operating gas flows to the low pressure inlet port 10*b*.

The high pressure outlet port 10*a* connects to a high pressure passage 11 branched to a first high pressure passage 11*a* and a second high pressure passage 11*b*. The low pressure outlet port 10*b* connects to a low pressure passage 12 branched to a first low pressure passage 12*a* and a second low pressure passage 12*b*.

The valve unit 20 comprises a first high pressure on-off valve 21, a first low pressure on-off valve 22, a second high pressure on-off valve 23, a second low pressure on-off valve 24 and a buffer side on-off valve 25. The first high pressure on-off valve 21 is connected with the first high pressure passage 11*a*, the first low pressure on-off valve 22 is connected with the first low pressure passage 12*a*, the second high pressure on-off valve 23 is connected with the second high pressure passage 11*b* and the second low pressure on-off valve 24 is connected with the second low pressure passage 12*b*. In brief, the first high pressure on-off valve 21 is connected with the high pressure outlet port 10*a* of the compressor 10 through the first high pressure passage 11*a* and the high pressure passage 11. The second high pressure on-off valve 23 is connected with the high pressure outlet port 10*a* of the compressor 14 through the second high pressure passage 11*b* and the high pressure passage 11. Similarly, the first low pressure on-off valve 22 is connected with the low pressure outlet port 10*b* of the compressor 10 through the first low pressure passage 12*a* and the low pressure passage 12. The second low pressure on-off valve 24 is connected with the low pressure outlet port 10*b* of the compressor 10 through the second low pressure passage 12*b* and the low pressure passage 12.

Each on-off valve 21, 22, 23, 24 and 25 may be comprised of a rotary valve having a rotor and a stator in this embodiment. The on-off condition of the each valve is controlled by the rotation of the rotor by a driving means such as a motor.

The cryocooler 30 is comprises a regenerator 31, a cold head 32, a pulse tube 33 and a radiator 34 arranged in series in line. The regenerator 31 is composed of layers of metal mesh such as copper as a regenerative material in a hollow cylindrical tube (regenerative tube) made of adiabatic material such as a stainless material. One end of the regenerator 31 is a cold end 31*a* and the other end is a hot end 31*b*. The hot end 31*b* is connected with the first high pressure on-off valve 21 and the first low pressure on-off valve 22 through a passage 61.

The cold head 32 made of a good heat conductive material such as a copper is provided with an annular passage for the fluid communication of the operating gas inside. The cold head 32 is attached to the cold end 31 a of the regenerator 31.

The pulse tube 33 comprises a hollow cylindrical tube made of an insulating material such as stainless steel. One end of the pulse tube 33 is a cold end 33*a* and the other end is a hot end 33*b*. The cold head 32 is also attached to the cold end 33*a* of the pulse tube 33.

The hot end 33*b* of the pulse tube 33 is provided with the radiator 34. The radiator 34 diffuses the heat in the cryocooler 30 to the exterior. Both a water-cooling system and an aircooling system can be applied to the radiator 34. Winding a cooling water tube around the outer periphery of the pulse tube 33 can be used as the water-cooling system. Attaching a cooling fin to the hot end 33*b* of the pulse tube 33 can be used as the air-cooling system. By designing the shape of the radiator 34, the operating gas in the pulse tube 33 can be rectified.

The fluid shield 40 prevents the generation of a DC flow in the pulse rube refrigerator. The fluid shield 40 comprises a cylinder member 41, a piston 42, a piston ring 43, a first spring 44 and a second spring 45. The cylinder member 41 is a hollow cylindrical tube made of an insulating material such as stainless steel. The piston 42 may be made of a plastic or other material and has the piston ring 43 on the outer periphery thereof. The piston is reciprocally disposed in the cylinder member 41. The piston 42 and the piston ring 43 separate the interior of the cylinder member 41 into a first space 46 and a second space 47.

An end surface 41*a* of the cylinder member 41 is connected with one end of a passage 62. The other end of the passage 62 is connected with the pulse tube 33 via the radiator 34 in the cryocooler 30. Since the end surface 41*a* of the cylinder member 41 is a part of a wall surface surrounding the first space 46, the first space 46 is connected with the inner space of the pulse tube 33 through the passage 62 and the radiator 34.

The other end surface 41*b* of the cylinder member 41 is connected with one end of a passage 63. The passage 63 is branched, and two of the branches are connected with the second high pressure on-off valve 23 and the second low pressure on-off valve 24. In brief, the cylinder member 41 is connected with the second high pressure on-off valve 23 and the second low pressure on-off valve 24 through the passage 63. Since the end surface 41*b* of the cylinder member 41 is a part of a wall surface surrounding the second space 47, the second space 47 is connected with the second high pressure on-off valve 23 and the second low pressure on-off valve 24 through the passage 63.

The first spring 44 is arranged in the first space 46. One end of the first spring 44 is fixed to an end surface 42*a* of the piston 42 and the other end is fixed to the inner wall side of the end surface 41*a* of the cylinder member 41. The second spring 45 is arranged in the second space 47. One end of the second spring 45 is fixed to an end surface 42*b* of the piston 42 and the other end is fixed to the inner wall side of the end surface 41*b* of the cylinder member 41.

The passage 63 is connected with one end of a passage 64. The other end of the passage 64 is connected with the buffer tank 50. In brief, the space in the buffer tank 50 (the buffer space) is connected with the second space 47 through the passage 64. The buffer side on-off valve 25 is provided in the middle of the passage 64. In brief, the buffer side on-off valve 25 is provided between the buffer space and the second space 47.

Figure 2:
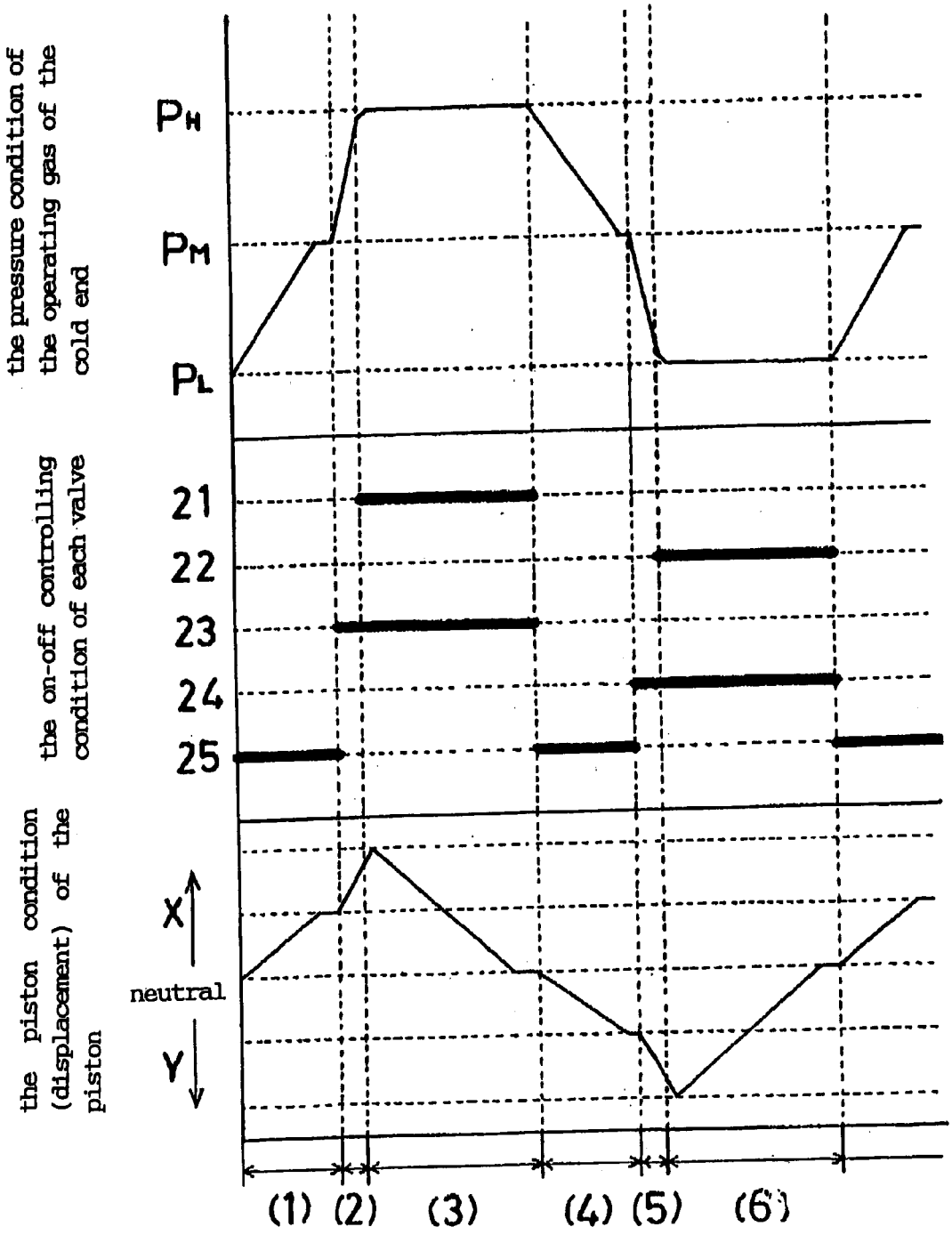
FIG. 2 is a graph illustrating a pressure condition in the cold end of the pulse tube over time, on-off controlling operations of each of the on-off valves over time, and a displacement of the piston when the pulse tube refrigerator in the first embodiment is in operation.

FIG. 2 is a graph showing the timewise on-off controlling operations of each on-off valve 21, 22, 23, 24 and 25 when the refrigerator 101 is in operation. The timewise pressure conditions of the operating gas in the pulse tube 33 (mainly the cold end 33*a* side) based on the on-off controlling operations are also illustrated in FIG. 2. The timewise displacement of the piston 42 in the cylinder member 41 is also illustrated In FIG. 2. The upper graph line shows the pressure condition of the operating gas of the cold end 33*a* side in the pulse tube 33. The middle graph line shows the on-off controlling condition of each valve 21, 22, 23, 24 and 25. The lower graph line shows the displacement of the piston 42 in the cylinder member 41. In the upper graph, PH in a vertical axis refers to a high pressure generated by the compressor 10 (a pressure in the high pressure passage 11, the first high pressure passage 11*a* and the second high pressure passage 11*b* connected with the high pressure outlet port 10*a* of the compressor 10). PL refers to a low pressure generated in the compressor 10 (a pressure in the low pressure passage 12, the first low pressure passage 12*a* and the second low pressure passage 12*b* connected with the low pressure inlet port 10*b* of the compressor 10). PM refers to a pressure in the buffer tank 50. PM is approximately an intermediate pressure between the high pressure PH and the low pressure PL. PM is set to be (PH+PL)/2. In the middle graph, numerals in a vertical axis refer to the same reference numerals of each on-off valve used in FIG. 1. Bold lines show the on-condition and the other parts show the off-condition. In the lower graph, changes in the X direction in the vertical axis correspond to changes in the X direction of the piston 42 shown in FIG. 1. Changes in the Y direction in the vertical axis correspond to changes in the Y direction of the piston 42 shown in FIG. 1.

In the present embodiment, the pressure of the operating gas and the displacement conditions in the pulse tube refrigerator are classified into six sequential processes. Each process will be explained hereinafter.

First Half of the Compression Process

To begin with, only the buffer side on-off valve 25 is open when the first space 46 and the second space 47 are under low pressure (PL) condition. Then the operating gas of the intermediate pressure (PM) in the buffer tank 50 flows into the second space 47 in the cylinder member 41 through the passages 64, 63. In this manner, the low pressure (PL) in the second space 47 becomes the intermediate pressure (PM). Since a pressure difference is generated between the intermediate pressure (PM) in the second space 47 and the low pressure (PL) in the first space 46, the piston 42 moves in the X direction in FIG. 1. Accordingly, since the volume of the first space 46 is decreased, the operating gas is pushed to flow into the hot end 33*b* side of the pulse tube 33 through the passage 62. In accordance with this, the operating gas in the cold end 33*a* side of the pulse tube 33 is compressed and the low pressure (PL) is increased to nearly the same as the intermediate pressure (PM). The movement of the piston 42 is stopped when the pressure difference between the pressure in the first space 46 and the pressure in the second space 47, and the expanding force of the spring 44 and the compressing force of the spring 45, become balanced.

Second Half of the Compression Process

When the buffer side on-off valve 25 is closed and only the second high pressure on-off valve 23 is open, the operating gas of high pressure (PH) in the second high pressure passage 11*b* flows via the second high pressure on-off valve 23 into the second space 47 in the cylinder member 41 through the passage 63. In this manner, the intermediate pressure (PM) in the second space 47 becomes the high pressure (PH). Due to the imbalance of force with the piston 42 being stopped as described in (1), the piston 42 moves more in the X direction in FIG. 1. Accordingly, since the volume of the first space 46 is decreased, the operating gas is compressed and flows from the hot end 33*b* side of the pulse tube 33 into the pulse tube 33 through the passage 62. The operating gas in the cold end 33*a* side of the pulse tube 33 is accordingly compressed and the intermediate pressure (PH) is increased. The movement of the piston 42 is stopped when the pressure difference between the pressure in the first space 46 and the pressure in the second space 47, and the expanding force of the spring 44 and the compressing force of the spring 45, become balanced.

High Pressure Transmitting Process

In second half of the compression process described in (2), when the pressure of the operating gas in the cold end 33*a* side of the pulse tube 33 is increased to a pressure less than the high pressure (PH) by 0.1~0.2 Mpa, the first high pressure on-off valve 21 is open with the second high pressure on-off valve 23 being open. Then, the operating gas of the high pressure (PH) in the first high pressure passage 11*a* flows from the hot end 31*b* of the regenerator 31 into the cryocooler 30 through the first high pressure on-off valve 21 and the passage 61. Accordingly, the pressure in the cryocooler 30 and the first space 46 of the cylinder member 41 connected with the cryocooler 30 become the high pressure (PH). Since the pressure difference between the first space 46 and the second space 47 becomes zero, the piston 42 moves in the Y direction in FIG. 1 and stops when the piston 42 reaches a neutral position. By the movement of the piston 42, the operating gas in the pulse tube 33 flows into the first space 46 through the passage 62. Accordingly, the operating gas in the regenerator 31, being refrigerated by the regenerator materials in the regenerator 31, flows into the cold end 33*a* side of the pulse tube 33.

First Half of the Expansion Process

After the first high pressure on-off valve 21 and the second high pressure on-off valve 23 are closed, only the buffer side on-off valve 25 is open. Then, the operating gas under the high pressure (PH) condition in the second space 47 of the cylinder member 41 flows into the buffer tank 50 under the intermediate pressure (PM) condition through the passages 63, 64 and the buffer side on-off valve 25. Accordingly, the pressure in the second space 47 falls to the intermediate pressure (PM) from the high pressure (PH). Since the pressure difference is generated between the intermediate pressure (PM) of the second space 47 and the high pressure (PH) in the first space 46, the piston 42 moves in the Y direction in FIG. 1. Since the volume of the first space 46 is increased, the operating gas in the hot end 33*b* of the pulse tube 33 flows into the first space 46 through the passage 62. Accordingly, the operating gas in the cold end 33*a* of the pulse tube 33 is expanded adiabatically in the pulse tube 33. Due to the adiabatic expansion, refrigeration is generated in the cold end 33*a* of the pulse tube 33. The movement of the piston 42 is stopped when the pressure difference between the pressure in the first space 46 and the pressure in the second space 47, and the expanding force of the spring 44 and the compressing force of the spring 45, become balanced.

Second Half of the Expansion Process

After the buffer side on-off valve 25 is closed, only the second low pressure on-off valve 24 is open, the operating gas under the intermediate pressure (PM) in the second space 47 flows into the second low pressure passage 12*b* through the passage 63 and the second low pressure on-off valve 24. In this manner, the intermediate pressure (PM) in the second space 47 falls to the low pressure (PL). Due to the imbalance of force with the piston 42 being stopped, the piston 42 then moves further in the Y direction in FIG. 1. Since the volume of the first space 46 is increased, the operating gas in the hot end 33*b* of the pulse tube 33 flows into the first space 46 through the passage 62. Accordingly, the operating gas in the cold end 33*a* of the pulse tube 33 is more expanded adiabatically in the pulse tube 33. Due to the adiabatic expansion, refrigeration is further generated in the cold end 33*a* of the pulse tube 33. The movement of the piston 42 is stopped when the pressure difference between the pressure in the first space 46 and the pressure in the second space 47, and the expanding force of the spring 44 and the compressing force of the spring 45, become balanced.

Low Pressure Transmitting Process

In second half of the expansion process described in (5), when the pressure of the operating gas in the cold end 33*a* side of the pulse tube 33 is decreased to a pressure more than the low pressure (PL) by 0.1~0.2 Mpa, the first low pressure on-off valve 22 is opened with the second low pressure on-off valve 24 being open. Then, the operating gas in the cryocooler 30 flows from the hot end 31*b* of the regenerator 31 into the first low pressure passage 12*a* through the passage 61 and the first low pressure on-off valve 22. Accordingly, the pressure in the cryocooler 30 and the first space 46 of the cylinder member 41 connected with the cryocooler 30 become the low pressure (PL). Since the pressure difference becomes zero between the first space 46 and the second space 47, the piston 42 moves in the X direction in FIG. 1 and stops when the piston 42 reaches the neutral position. By the movement of the piston 42, the operating gas in the first space 46 flows from the cold end 33*a* side into the pulse tube 33 through the passage 62. Accordingly, the low temperature operating gas in the cold end 33*a* side of the pulse tube 33 flows into the cold end 31*a* side of the regenerator 31 through the cold head 32.

By repeating a cycle of the above described processes (1) through (6), a cryogenic temperature can be generated in the cold end 33*a* side of the pulse tube 33. The cryogenic temperature is transmitted to the cold head 32 and the refrigeration of the object to be refrigerated can be achieved by a thermal contact of the object with the cold head 32.

In the pulse tube refrigerator 101, since there is not a closed circuit between the cryocooler 30 and the compressor 10 due to the piston 42 and ring 43, DC flow will not be generated. Accordingly, heat is not transmitted to the low temperature portion by the DC flow, and the refrigeration efficiency can be improved.

Next, in the pulse tube refrigerator 101 of this embodiment, the on-off valve loss, when the second high pressure on-off valve 23 and the second low pressure on-off valve 24 are opened, will be explained compared to the conventional pulse tube refrigerator.

In the process (2), when the second high pressure on-off valve 23 is opened, one space connected with the second high pressure on-off valve 23 is the space in the second high pressure passage 11*b* and the other space is the second space 47 of the cylinder member 41. The pressure in the second high pressure passage 11*b* is the high pressure (PH). The pressure in the second space 47 is the intermediate pressure (PM), since the operating gas in the buffer tank 50 flows to the second space 47 by opening the buffer side on-off valve 25 in the process (1), wherein PM is set to be (PH+PL)/2, and the pressure difference P is set to be (PH−PL)/2. However, since the process (1) is omitted in the conventional method, the pressure in the second space still maintains the low pressure (PL). In the conventional method, when the second high pressure on-off valve 23 is opened, the pressure difference PO is set to be (PH−PL). Accordingly, the pressure difference P according to the embodiment is a half of the conventional pressure difference PO. Since the on-off valve loss is increased in proportion to the pressure difference, when the second high pressure on-off valve 23 is opened, the refrigeration efficiency of the pulse tube refrigerator of this embodiment has been improved by reducing the on-off valve loss compared to the conventional pulse tube refrigerator.

In the process (5), when the second low pressure on off valve 24 is opened, one space connected with the second low pressure on-off valve 24 is the space in the second low pressure passage 12*b* and the other space is the second space 47 of the cylinder member 41. The pressure in the second low pressure passage 12*b* is the low pressure (PL). The pressure in the second space 47 is the intermediate pressure (PM), since the operating gas in the second space 47 has flowed to the buffer tank 50 by opening the buffer side on-off valve 25 in the process (4). Accordingly, the pressure difference P is set to be (PH−PL)/2. However, since the process (4) is omitted by the conventional method, the pressure in the second space still maintains the high pressure (PH). In the conventional method, when the second low pressure on-off valve is opened, the pressure difference PO is set to be (PH−PL). Accordingly, the pressure difference P according to the embodiment of the invention is a half of the conventional pressure difference PO. Since the on-off valve loss is increased in proportion to the pressure difference, when the second low pressure on-off valve 24 is opened, the refrigeration efficiency of the pulse tube refrigerator of this embodiment has been improved by reducing the on-off valve loss compared to the conventional pulse tube refrigerator.

In the foregoing explanation, the pulse tube refrigerator 101 comprises the compressor 10, the first high pressure on-off valve 21 and the second high pressure on-off valve 23 connected with the high pressure outlet port 10*a* of the compressor 10, the first low pressure on-off valve 22 and the second low pressure on-off valve 24 connected with the low pressure inlet port 10*b* of the compressor 10, the cryocooler 30 having the regenerator 31, the cold head 32 and the pulse tube 33 arranged in series in line connected with the first high pressure on-off valve 21 and the second high pressure on-off valve 23 through the regenerator 31, the cylinder member 41 in which one end is connected with the pulse tube 33 and the other end is connected with the second high pressure on-off valve 23 and the second low pressure on-off valve 24, the piston 42 arranged in the cylinder member 41 and separating the interior of the cylinder member 41 into the first space 46 connected with the inner space of the pulse tube 33 and the second space 47 connected with the second high pressure on-off valve 23 and the second low pressure on-off valve 24, the buffer space (the buffer tank 50) connected with the second space 47 and the buffer side on-off valve 25 disposed between the buffer space (the buffer tank 50) and the second space 47.

In this manner, in the first half of the compression process (1), the low pressure of the second space 47 can be increased up to the intermediate pressure (PM) of in the buffer space by opening the buffer side on-off valve 25. Then in the second half of the compression process (2), the pressure in the second space 47 becomes the high pressure (PH) by opening the second high pressure on-off valve 23. In the first half of the expansion process (4), the high pressure in the second space 47 can be decreased to the intermediate pressure (PM) in the buffer space by opening the buffer side on-off valve 25. Then in the second half of the expansion process (5), the pressure in the second space 47 becomes the low pressure (PL) by opening the second low pressure on-off valve 24. Accordingly, the pressure difference when the second high pressure on-off valve 23 and the second low pressure on-off valve 24 are opened can be decreased compared to the conventional one. The on-off valve loss in proportion to the pressure difference can be decreased and the refrigeration efficiency can be improved.

Further, the piston 42 is elastically supported by the first spring 44 and the second spring 45 as elastic elements in the cylinder member 41. As a result, the moving stability of the piston 42 in the cylinder member 41 is assured.

Second Embodiment

Figure 3:
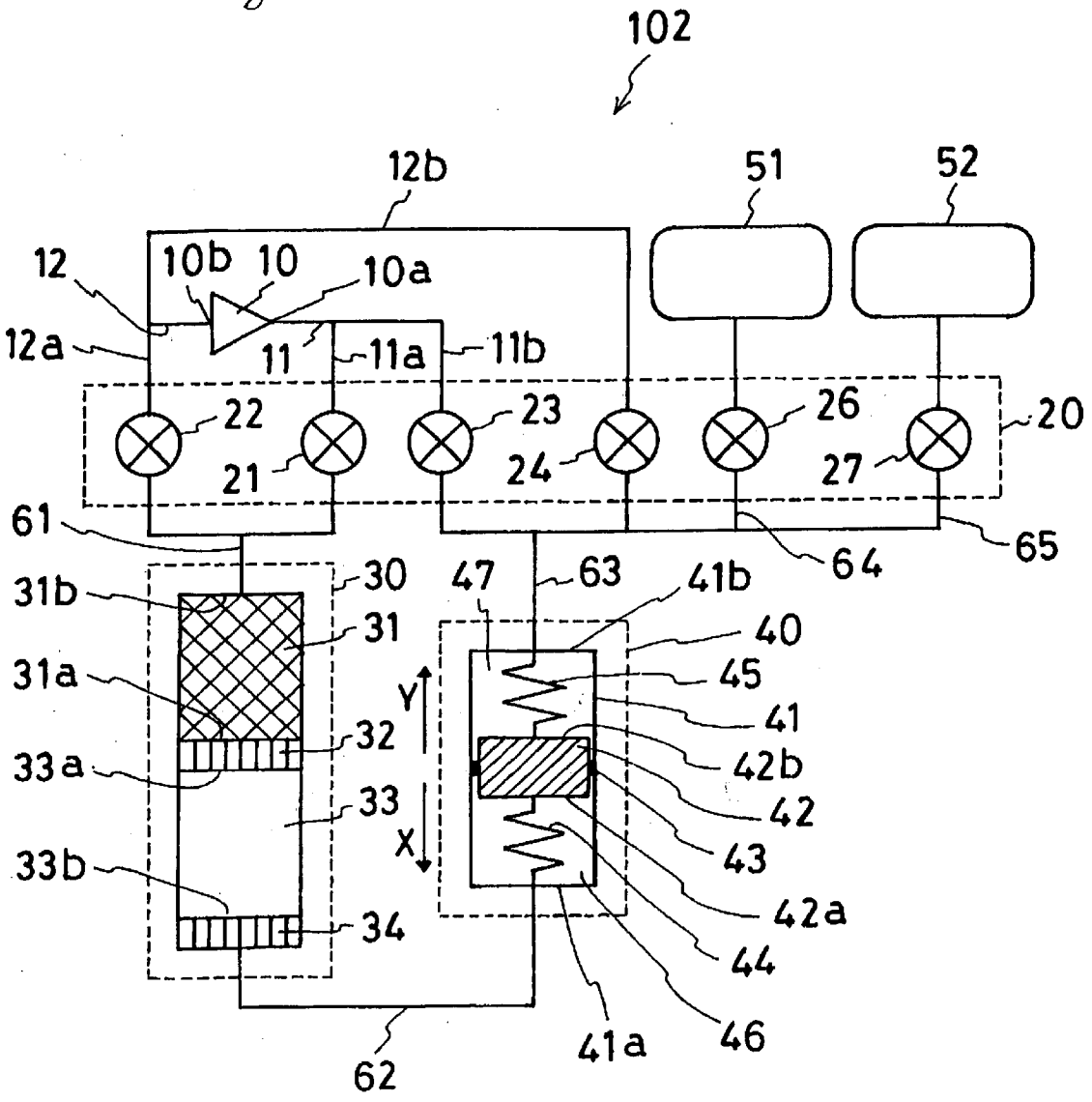
FIG. 3 is a schematic illustration of a pulse tube refrigerator of a second embodiment of the present invention.
Figure 4:
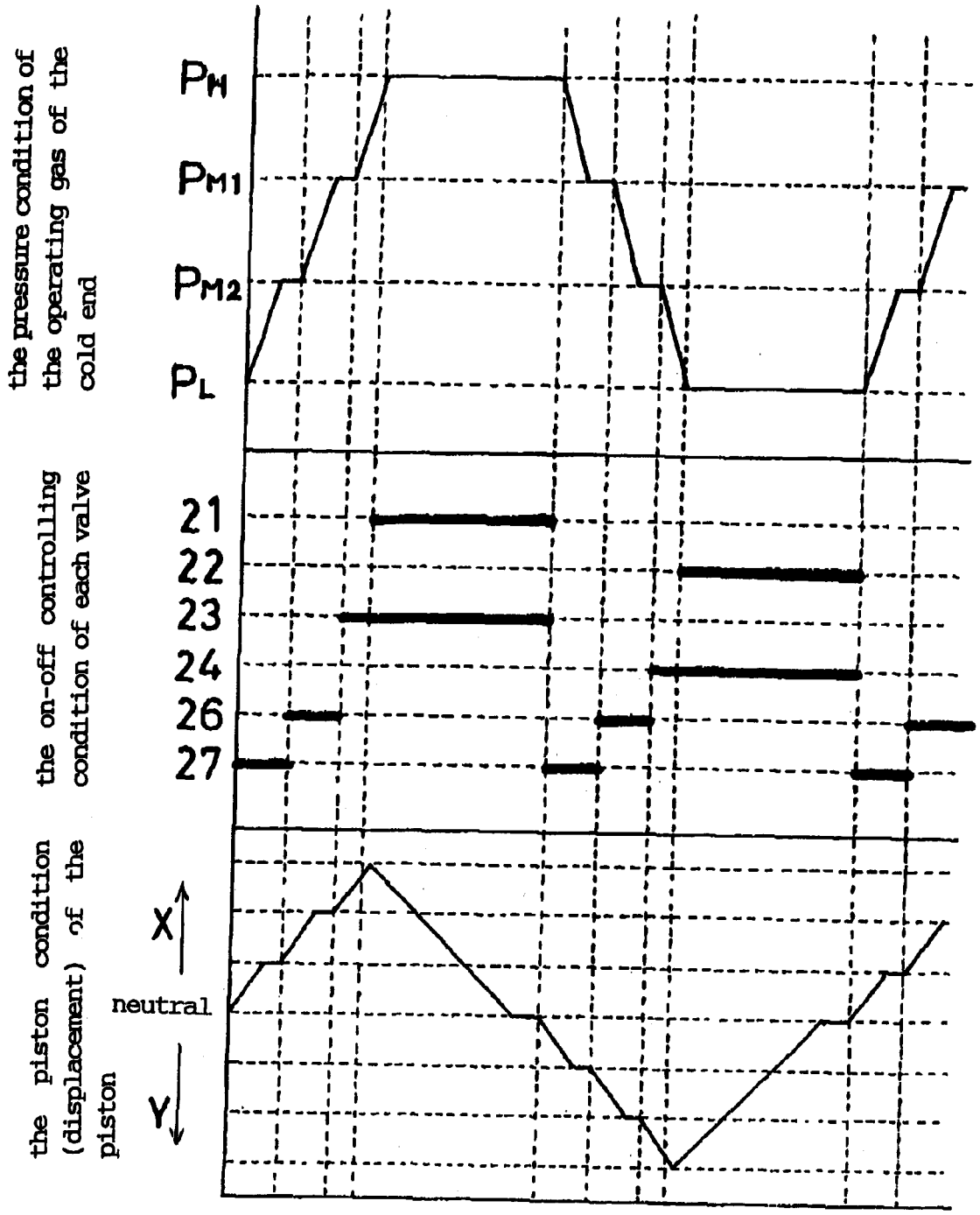
FIG. 4 is a graph illustrating a pressure condition in the cold end of the pulse tube over time, on-off controlling operations of each of the on-off valves over time, and a displacement of the piston when the pulse tube refrigerator in the second embodiment is in operation.

Referring now to the second embodiment of the invention with the reference to FIGS. 3, 4, FIG. 3 is a whole schematic illustration of a pulse tube refrigerator of the second embodiment of the invention. In the drawings, a pulse tube refrigerator 102 includes basically the same structure to the pulse tube refrigerator 101 in FIG. 1, except that the pulse tube refrigerator 102 includes another buffer tank and buffer side on-off valve. The other parts with same reference numbers to those in FIG. 3 are the same elements as in the pulse tube refrigerator 101 in FIG. 1, and the explanation thereof will be omitted. Mainly, the differences will be explained hereinafter.

In FIG. 3, the valve unit 20 is provided with the first high pressure on-off valve 21, the first low pressure on-off valve 22, the second high pressure on-off valve 23, the second low pressure on-off valve 24, a first buffer side on-off valve 26 and a second buffer side on-off valve 27. Each on-off valve 21, 22, 23, 24, 26 and 27 may be comprised of a rotary valve having a rotor and a stator in this embodiment. The on-off condition of the each valve is controlled by the rotation of the rotor by a driving means such as a motor.

The passage 63 between the fluid shield 40 and the second high pressure on-off valve 23 and the second low pressure on-off valve 24 is connected with one end of the passage 64. The other end of the passage 64 is connected with a first buffer tank 51 so as to connect the first buffer tank 51 (a first buffer space) with the second space 47 in the cylinder member 41 through the passage 64. The first buffer side on-off valve 26 is provided in the middle of the passage 64 so as to interpose the first buffer side on-off valve 26 between the first buffer space and the second space 47.

The passage 64 is connected with one end of a passage 65. The other end of the passage 65 is connected with a second buffer tank 52 so as to connect the second buffer tank 52 (a second buffer space) with the second space 47 in the cylinder member 41 through the passage 65. The second buffer side on-off valve 27 is provided in the middle of the passage 65 so as to interpose the second buffer side on-off valve 27 between the second buffer space and the second space 47.

FIG. 4 is a graph showing the timewise on-off controlling operations of each on-off valve 21, 22, 23, 24, 26 and 27 when the refrigerator 201 in FIG. 3 is in operation. The timewise pressure conditions of the operating gas in the pulse tube 33 (mainly the cold end 33*a* side) based on the on-off controlling operations is also illustrated in FIG. 4. The timewise displacement of the piston 42 in the cylinder member 41 is also illustrated in FIG. 4. The upper graph line shows the pressure conditions of the operating gas of the cold end 33*a* side in the pulse tube 33. The middle graph line shows the on-off controlling condition of each valve 21, 22, 23, 24, 26 and 27. The lower graph line shows the displacement of the piston 42 in the cylinder member 41. In the upper stand graph, PM1 refers to a pressure in the first buffer tank 51 (a first intermediate pressure) and PM2 refers to a pressure in the second buffer tank 52 (a second intermediate pressure). As a matter of convenience in explanation, PM1 and PM2 divide the pressure difference between PH and PL equally in thirds, with the first intermediate pressure PM1 higher than the second intermediate pressure PM2. More specifically, the first intermediate pressure PM1 is set to be (2PH+PL)/3. The second intermediate pressure PM2 is set to be (PH+2PL)/3. In the middle graph, numerals on the vertical axis refer to the same reference numerals of each on-off valve used in FIG. 1. Other items in FIG. 4 are the same as FIG. 2. In the first embodiment of the invention, the compression process of the operating gas is divided into two (the first half of the compression process and the second half of the compression process). In the second embodiment of the invention, the compression process of the operating gas is divided into three (the initial part of the compression process, the intermediate part of the compression process and the final part of the compression process). In the first embodiment, the expansion process of the operating gas is divided into two (the first half of the expansion process and the second half of the expansion process). In the second embodiment, the expansion process of the operating gas is divided into three (the initial part of the expansion process, the intermediate part of the expansion process and the final part of the expansion process). Since the high pressure transmitting process and the low pressure transmitting process are the same as the first embodiment, a detailed explanation will be omitted. Mainly, the compression process and the expansion process will be explained hereinafter.

Initial Part of the Compression Process

To begin with, only the second buffer side on-off valve 27 is open when the first space 46 and the second space 47 are under the low pressure (PL) condition. Then the operating gas of the second intermediate pressure (PM2) in the second buffer tank 52 flows from the second buffer side on-off valve 27 into the second space 47 in the cylinder member 41 through the passages 65, 64 and 63. In this manner, the low pressure (PL) in the second space 47 becomes the second intermediate pressure (PM2). Since a pressure difference is generated between the second intermediate pressure (PM2) in the second space 47 and the low pressure (PL) in the first space 46, the piston 42 moves in the X direction in FIG. 3. Accordingly, since the volume of the first space 46 is decreased, the operating gas is pushed to flow into the hot end 33*b* side of the pulse tube 33 through the passage 62. Accordingly, the operating gas in the cold end 33*a* side of the pulse tube 33 is compressed and the low pressure (PL) is increased to be nearly the same as the second intermediate pressure (PM2). The movement of the piston 42 is stopped when the pressure difference between the pressure in the first space 46 and the pressure in the second space 47, and the expanding force of the spring 44 and the compressing force of the spring 45, become balanced.

Intermediate Part of the Compression Process

When the second buffer side on-off valve 27 is closed and only the first buffer side on-off valve 26 is open, the operating gas of the first intermediate pressure (PM1) in the first buffer tank 51 flows from the first buffer side on-off valve 26 into the second space 47 in the cylinder member 41 through the passages 64, 63. In this manner, the second intermediate pressure (PM2) in the second space 47 becomes the first intermediate pressure (PM1). Due to the imbalance of force with the piston 42 being stopped as described in (1), the piston 42 then further moves in the X direction in FIG. 3. Accordingly, since the volume of the first space 46 is further decreased, the operating gas is compressed and flows into the hot end 33*b* side of the pulse tube 33 through the passage 62. Accordingly, the operating gas in the cold end 33*a* side of the pulse tube 33 is further compressed and the second intermediate pressure (PM2) is increased to nearly the same as the first intermediate pressure (PM1). The movement of the piston 42 is stopped when the pressure difference between the pressure in the first space 46 and the pressure in the second space 47, and the expanding force of the spring 44 and the compressing force of the spring 45, become balanced.

Final Part of the Compression Process

When the first buffer side on-off valve 26 is closed and only the second high pressure on-off valve 23 is open, the operating gas of the high pressure (PH) in the second high pressure passage 11*b* flows from the second high pressure on-off valve 23 into the second space 47 in the cylinder member 41 through the passages 63. In this manner, the first intermediate pressure (PM1) in the second space 47 becomes the high pressure (PH). Due to the imbalance of force with the piston 42 being stopped as described in (2), the piston 42 then further moves in the X direction in FIG. 3. Accordingly, since the volume of the first space 46 is further decreased, the operating gas is compressed and flows from the hot end 33*b* side of the pulse tube 33 through the passage 62. Accordingly, the operating gas in the cold end 33*a* side of the pulse tube 33 is further compressed and the first intermediate pressure (PM1) is increased. The movement of the piston 42 is stopped when the pressure difference between the pressure in the first space 46 and the pressure in the second space 47, and the expanding force of the spring 44 and the compressing force of the spring 45, become balanced.

High Pressure Transmitting Process

Since the high pressure transmitting process in the second embodiment is the same as (3) in the first embodiment, its explanation will be omitted.

Initial Part of the Expansion Process

By virtue of the high pressure transmitting process, the cryocooler 30, the first space 46 and the second space 47 are at the high pressure (PH). After that, the first high pressure on-off valve 21 and the second high pressure on-off valve 23 are closed, and only the first buffer side on-off valve 26 is open. Then the operating gas under the high pressure (PH) condition in the second space 47 of the cylinder member 41 flows into the buffer talk 51 which is under the first intermediate pressure (PM1) condition through the passages 63, 64 and the first buffer side on-off valve 26. Accordingly, the pressure in the second space 47 falls to the first intermediate pressure (PM1) from the high pressure (PH). Since a pressure difference is generated between the first intermediate pressure (PM1) of the second space 47 and the high pressure (PH) in the first space 46, the piston 42 moves in the Y direction in FIG. 3. Since the volume of the first space 46 is increased, the operating gas in the hot end 33*b* of the pulse tube 33 flows into the first space 46 through the passage 62. Accordingly, the operating gas in the cold end 33*a* of the pulse tube 33 is expanded adiabatically in the pulse tube 33. Due to the adiabatic expansion, refrigeration is generated in the cold end 33*a* of the pulse tube 33. The movement of the piston 42 is stopped when the pressure difference between the pressure in the first space 46 and the pressure in the second space 47, and the expanding force of the spring 44 and the compressing force of the spring 45, become balanced.

Intermediate Part of the Expansion Process

After the first buffer side on-off valve 26 is closed, only the second buffer side on-off valve 27 is open. Then, the operating gas under the first intermediate pressure (PM1) condition in the second space 47 of the cylinder member 41 flows into the buffer tank 52 which is under the second intermediate pressure (PM2) condition, through the passages 63, 64, 65 and the second buffer side on-off valve 27. Accordingly, the pressure in the second space 47 falls to the second intermediate pressure (PM2) from the first intermediate pressure (PM1). Due to the imbalance of force with the piston 42 being stopped as described in (5), the piston 42 then further moves in the Y direction in FIG. 3. Since the volume of the first space 46 is further increased, the operating gas in the hot end 33*b* of the pulse tube 33 flows into the first space 46 through the passage 62. Accordingly, the operating gas in the cold end 33*a* of the pulse tube 33 is expanded adiabatically in the pulse tube 33. Due to the adiabatic expansion, refrigeration is generated in the cold end 33*a* of the pulse tube 33. The movement of the piston 42 is stopped when the pressure difference between the pressure in the first space 46 and the pressure in the second space 47, and the expanding force of the spring 44 and the compressing force of the spring 45, become balanced.

Final Part of the Expansion Process

After the second buffer side on-off valve 27 is closed, only the second low pressure on-off valve 24 is open. Then, the operating gas under the second intermediate pressure (PM2) pressure in the second space 47 flows into the second low pressure passage 12*b* through the passage 83 and the second low pressure on-off valve 24. In this manner, the second intermediate pressure (PM2) in the second space 47 drops to the low pressure (PL). Due to the imbalance of force with the piston 42 being stopped as described in (5), the piston 42 then further moves in the Y direction in FIG. 3. Since the volume of the first space 46 is increased, the operating gas in the hot end 33*b* of the pulse tube 33 flows into the first space 46 through the passage 62. Accordingly, the operating gas in the cold end 33*a* of the pulse tube 33 is further expanded adiabatically in the pulse tube 33. Due to the adiabatic expansion, more refrigeration is generated in the cold end 33*a* of the pulse tube 33. The movement of the piston 42 is stopped when the pressure difference between the pressure in the first space 46 and the pressure in the second space 47, and the expanding force of the spring 44 and the compressing force of the spring 45, become balanced.

Low Pressure Transmitting Process

Since the low pressure transmitting process in the second embodiment is the same as (6) in the first embodiment, its explanation will be omitted.

By repeating a cycle of above described processes (1) through (8), the cryogenic temperature can be generated in the cold end 33*a* side of the pulse tube 33. The cryogenic temperature is transmitted to the cold head 32, and the refrigeration of the object to be refrigerated can be achieved by the thermal contact of the object with the cold head 32.

The on-off valve loss of the pulse tube refrigerator in the second embodiment is decreased in comparison with that of the first embodiment. In the final part of the compression process (3), since before the second high pressure on-off valve 23 is open, the second space 47 in the cylinder member 41 is increased to the first intermediate pressure (PM1), the pressure difference of the spaces between both sides of the second high pressure on-off valve 23 P is set to be PH−PM1. Since PM1 is set to be (2PH+PL)/3, P is set to be (PH−PL)/3. Similarly, in the final part of the expansion process (7), since before the second low pressure on-off valve 24 is opened, the second space 47 in the cylinder member 41 is decreased to the second intermediate pressure (PM2), the pressure difference of the spaces between the both sides of the second low pressure on-off valve 24 P is set to be PM2−PL. Since PM2 is set to be (PH+2PL)/3, P is set to be (PH−PL)/3. Accordingly, the pressure difference becomes one third of the conventional pressure difference P=(PH−PL) when the second high pressure on-off valve and the second low pressure on-off valve are open. The refrigeration efficiency has been further improved by reducing the on-off valve loss.

The pulse tube refrigerator of the second embodiment includes the operation effect explained in the first embodiment and the other operation effect is also included.

Namely, in the pulse tube refrigerator of this embodiment, a plurality of buffer spaces (the first buffer space and the second buffer space in this case) are connected with the second space 47. The buffer side on-off valves (the first buffer side on-off valve 26, the second buffer side on-off valve 27) are provided respectively between each buffer space and the second space 47. The pressure in each buffer space can be supplied variably in accordance with the desired operation. Concurrently, as shown in (1), in the initial part of the compression process, (2) intermediate part of the compression process, (5) initial part of the expansion process and (6) intermediate part of the expansion process, each buffer side on-off valve 26, 27 is controlled so that the pressure in the second space 47 is increased or decreased gradually. Afterward, as shown in (3), the final part of the compression process, and (4) high pressure transmitting process, if the valve control is operated such that the second high pressure on-off valve 23 or the second low pressure on-off valve 24 is open, the pressure difference when the second high pressure on-off valve 23 and the second low pressure on-off valve 24 are open can be decreased. Accordingly, the refrigeration efficiency has been further improved by reducing the on-off valve loss.

Third Embodiment

Next, the third embodiment of the invention will be explained. What is called a two-stage pulse tube refrigerator in this embodiment can generate a cryogenic temperature (the liquefication temperature 4K of helium for instance) by providing two-stage cryocoolers. Since the structures of the compressor, valve unit and the buffer tank are the same as in the first embodiment, the same reference numbers refer to the same elements in the pulse tube refrigerator 101 in FIG. 1, and their explanation will be omitted. Mainly, the differences will be explained hereinafter.

Figure 5:
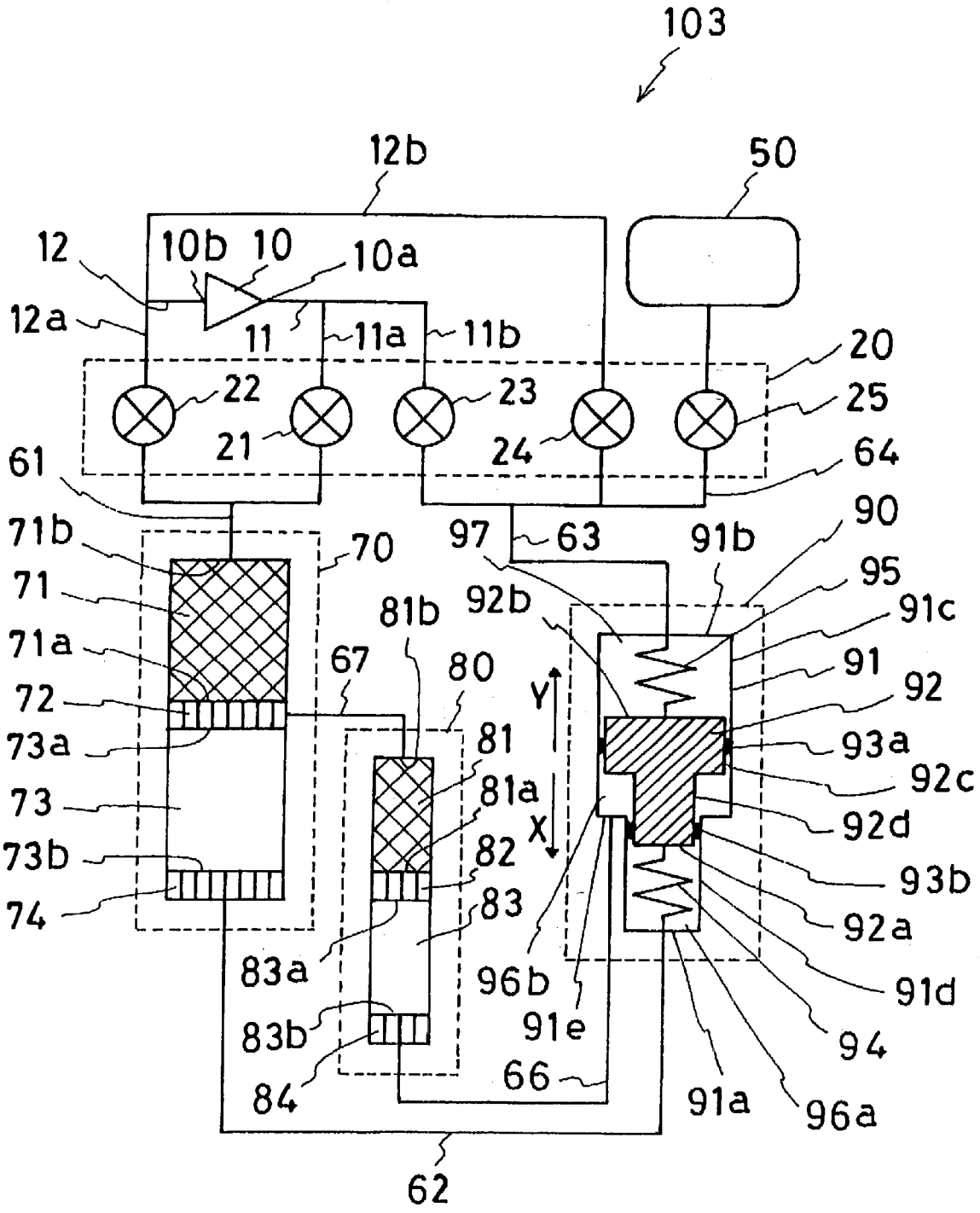
FIG. 5 is a schematic illustration of a pulse tube refrigerator of a third embodiment of the present invention.

FIG. 5 is a whole schematic illustration of a pulse tube refrigerator of the third embodiment of the invention. In the drawings, a pulse tube refrigerator 103 is provided with a first stage cryocooler 70 and a second stage cryocooler 80. The first stage cryocooler 70 comprises a first regenerator 71, a first cold head 72, a first pulse tube 73 and a first radiator 74 arranged in series in line. The second stage cryocooler 80 comprises a second regenerator 81, a second cold head 82, a second pulse tube 83 and a second radiator 84 arranged in series in line. The first cold head 72 is connected with one end of a passage 67. The other end of the passage 67 is connected with a hot end 81*b* of the second regenerator 81.

Since each element composing the cryocooler is basically the same as that in the first embodiment, a detailed explanation will be omitted. Since the regenerator materials in the regenerator 81 of the second cryocooler 80 need to have a large specific heat in a low temperature area, meshes or powders made a of the material having large magnetic specific heat such as Er3Ni, EuS can be preferably used.

The pulse tube refrigerator 103 is provided with a fluid shield 90. The fluid shield 90 includes a cylinder member 91, a stepped piston 92, a large diameter piston ring 93*a*, a small diameter piston ring 93*b*, a first spring 94 and a second spring 95. Cylinder member 91 has a large diameter portion 91 c and a small diameter portion 91 d. The stepped piston 92 has a large diameter portion 92*c* and a small diameter portion 92*d*. The large diameter piston ring 93*a* is attached on the outer periphery of the large diameter portion 92*c* and the small diameter piston ring 93*b* is attached on the outer periphery of the small diameter portion 92*d*.

The interior of the cylinder member 91 is divided into three spaces by the stepped piston 92 and the piston rings 93*a*, 93*b*. In more detail, the space in the small diameter portion 91*d* of the cylinder member 91 is defined as a small diameter space 96*a* by the small diameter portion 92*d* of the stepped piston 92 and the small diameter piston ring 93*b*. The space of the large diameter portion 91*c* of the cylinder member 91 is divided into two by the large diameter portion 92*c* of the stepped piston 92 and the large diameter piston ring 93*a*. The upper side of the divided space is defined as a large diameter space 97. The lower side of the divided space (the space between the large diameter space 97 and the small space 96*a*) is defined as a ring space 96*b* formed in a ring shape by the small diameter portion 92*d* of the stepped piston 92.

One end surface (a small end surface) 91*a* of the cylinder member 91 is connected with one end of the passage 62. The other end of the passage 62 is connected with the first pulse tube 73 via the first radiator 74 in the first cryocooler 70. A stepped surface 91*e* is connected with one end of a passage 66. The other end of the passage 66 is connected with the second pulse tube 83 via the second radiator 84 in the second cryocooler 80. Since the end portion 91 a of the cylinder member 91 is a part of the wall surface surrounding the small space 96*a*, the small space 96*a* is connected with the inner space of the first pulse tube 73 through the passage 62 and the first radiator 74. Similarly, since the stepped surface 91*e* of the cylinder member 91 is a part of the wall surface surrounding the ring space 96*b*, the ring space 96*b* is connected with the inner space of the second pulse tube 83 through the passage 66 and the second radiator 84.

The other end surface 91*b* of the cylinder member 91 is connected with one end of the passage 63. The passage 63 is branched, and the branched ends are connected with the second high pressure on-off valve 23 and the second low pressure on-off valve 24, respectively. Since the end portion 91*b* of the cylinder member 91 is a part of the wall surface surrounding the large space 97, the large space 97 is connected with the second high pressure on-off valve 23 and the second low pressure on-off valve 24 through the passage 63.

A first spring 94 is disposed in the small space 96*a*. One end of the first spring 94 is fixed to a small diameter end surface 92*a* of the stepped piston 92, and the other end is fixed to the inner wall of the end surface 91*a* of the cylinder member 91. A second spring 95 is disposed in the large diameter space 97. One end of the second spring 95 is fixed to a piston small diameter portion 92*b* of the stepped piston 92, and the other end is fixed to the other end surface 91*b* of the cylinder member 91.

In the pulse tube refrigerator 103, the timewise on-off controlling operations of each on-off valve 21, 22, 23, 24 and 25 when the refrigerator 103 is in operation, the pressure condition of the operating gas in a cold end 73*a* of the first pulse tube 73 and the pressure condition of the operating gas in a cold end 83*a* of the second pulse tube 83 based on the timewise on-off controlling operations, and the timewise displacement of the stepped piston 92 in the cylinder member 91 are the same as that in FIG. 2, as explained in the first embodiment. Since each process during operation is also the same as in the first embodiment, a detailed explanation of these processes is omitted.

In the pulse tube refrigerator 103, refrigeration is generated by the first cold head 72 and the second cold head 82. Since the first cold head 72 is connected with the second regenerator 81 through a passage 66, the refrigeration generated by the first cryocooler 70 is transmitted to the second cryocooler 80. Accordingly, the second cryocooler 80 can generate a lower temperature than the first cryocooler 70. For instance, the minimum temperature in the first cold head 72 in the first cryocooler 70 can be 70K, whereas the minimum temperature in the second cold head 82 in the second cryocooler 80 can be 4K.

In this embodiment, as in the first embodiment, when the second high pressure on-off valve 23 and the second low pressure on-off valve 24 are open, the pressure difference of the spaces of both ends of the on-off valves becomes half that of the conventional difference. Accordingly, the refrigeration efficiency has been improved by reducing the on-off valve loss.

The pulse tube refrigerator of the third embodiment includes the operation effect explained in the first embodiment. In addition, in the pulse tube refrigerator of the third embodiment, the cryocooler comprises the first cryocooler 70 connected with a the first high pressure on-off valve 21 and the first low pressure on-off valve 22 at the first regenerator 71 of the first cryocooler 70, and the second cryocooler 80 having the second regenerator 81, the second cold head 82 and the second pulse tube 83 arranged in series in line. By providing such a two stage pulse tube refrigerator, an extremely low temperature of 4K (liquefied helium temperature), for instance, can be generated in the second cryocooler 80.

Fourth Embodiment

Figure 6:
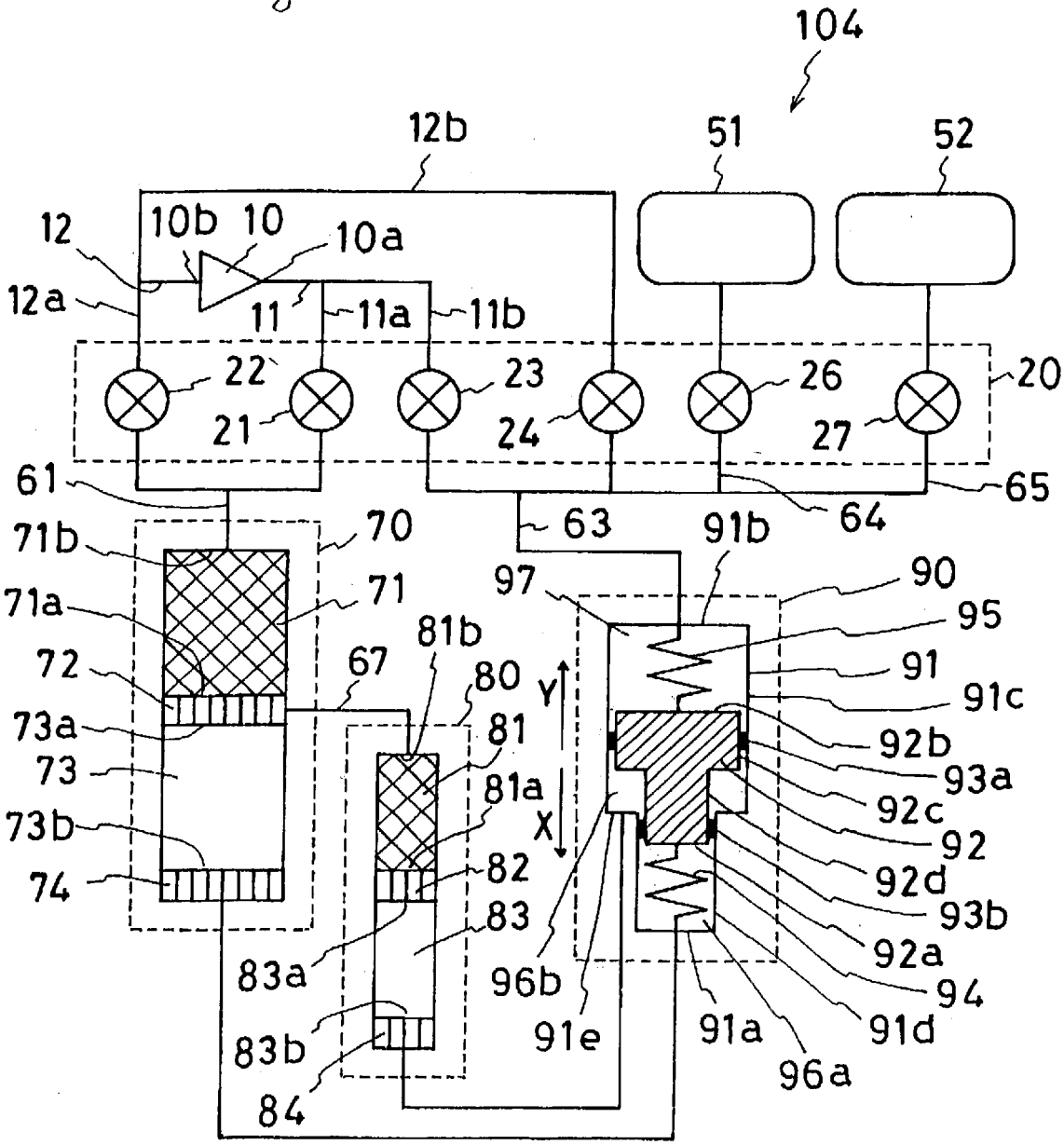
FIG. 6 is a schematic illustration of a pulse tube refrigerator of a forth embodiment of the present invention.

FIG. 6 is a whole schematic illustration of a pulse tube refrigerator of the fourth embodiment of the invention. The basic structure of a pulse tube refrigerator 104 in FIG. 6 is the same as the pulse tube refrigerator 103 (two stage pulse tube refrigerator) in FIG. 5. The pulse tube refrigerator 104 further comprises two buffer tanks. The pulse tube refrigerator 104 adapts another tank to the two stage pulse tube refrigerator 103. Since the basic structure is the same as the second or third embodiment, the same reference numbers refer to the same elements in the pulse tube refrigerator 102 in FIG. 3 and in the pulse tube refrigerator 103 in FIG. 5, and the explanation thereof will be omitted.

In the pulse tube refrigerator 104, the timewise on-off controlling operations when the refrigerator is in operation, the pressure condition of the operating gas in the cold end of the first and second pulse tubes based on the timewise on-off controlling operations, and the timewise displacement of the stepped piston in the cylinder member are the same as in FIG. 4, as explained for the second embodiment. Since each process during operation is omitted.

The pulse tube refrigerator of the fourth embodiment includes the operation effect explained in the first, second and third embodiments.

Fifth Embodiment

Figure 7:
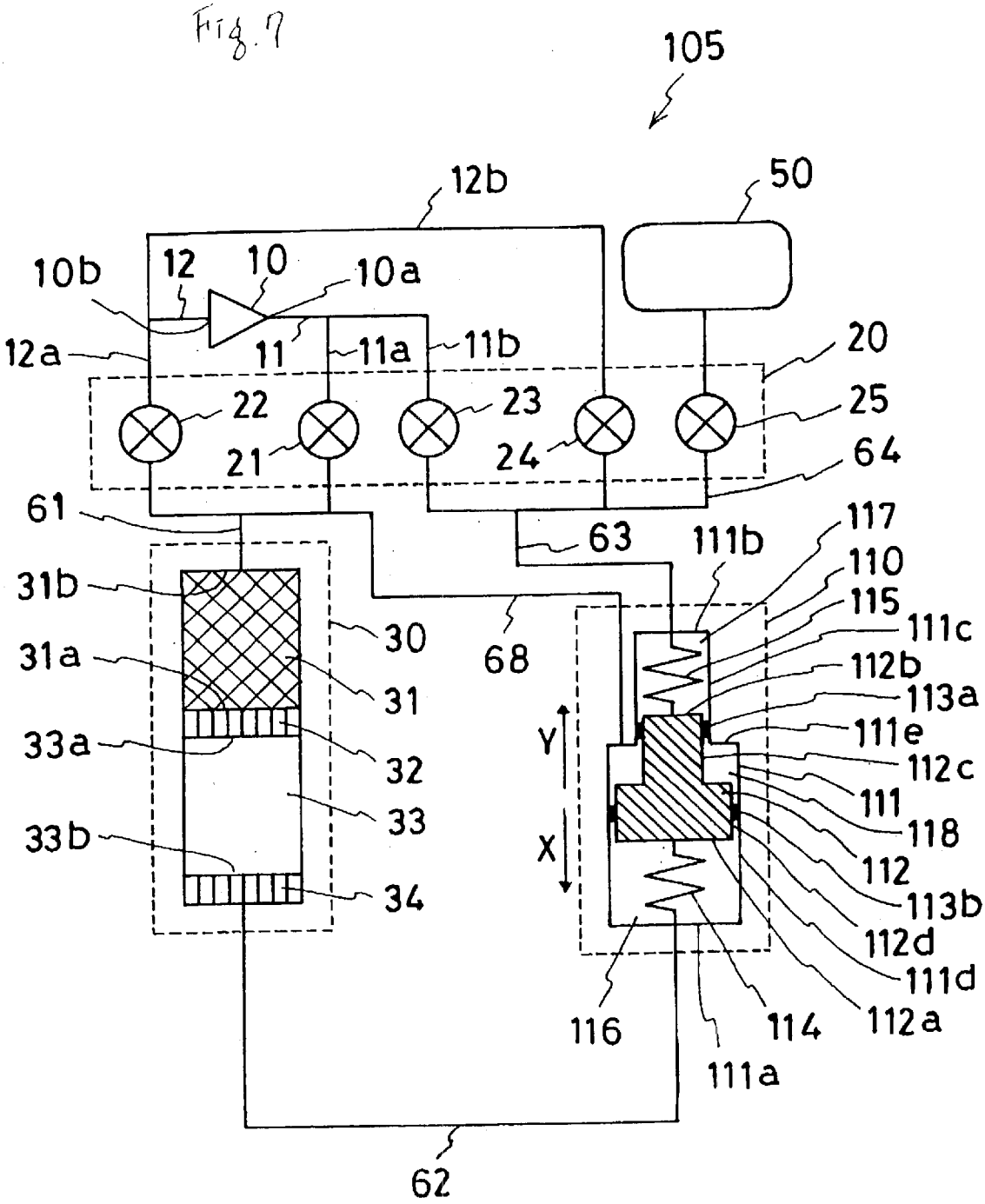
FIG. 7 is a schematic illustration of a pulse tube refrigerator of a fifth embodiment of the present invention.

FIG. 7 is a whole schematic illustration of a pulse tube refrigerator of the fifth embodiment of the invention. The basic structure of a pulse tube refrigerator 105 in FIG. 7 is the same as the pulse tube refrigerator 101 in FIG. 1. The pulse tube refrigerator 105 further comprises a displacer function in the fluid shield. Accordingly, same reference numbers refer to the same elements in the pulse tube refrigerator in FIG. 1, and the explanation thereof will be omitted. Mainly, the differences will be explained hereinafter.

In the pulse tube refrigerator 105 in FIG. 7, one end of the fluid shield 110 is connected with the cryocooler 30 through the passage 62, and the other end is connected with the second high pressure on-off valve 23 and the second low pressure on-off valve 24 through the passage 63. The fluid shield 110 is provided with a cylinder member 111, a stepped piston 12, a small diameter piston ring 113*a*, a large diameter piston ring 113*b*, a first spring 114 and a second spring 115. The cylinder member 111 has a stepped cylindrical shape which includes a small diameter portion 111*c* and a large diameter portion 111*d*. The stepped piston 112 has a stepped cylindrical shape which includes a small diameter portion 112*c* and a large diameter portion 112*d*. The small diameter piston ring 113*a* is attached on the outer periphery of the piston small diameter portion 112*c* and the large diameter piston ring 113*b* is attached on the outer periphery of the piston large diameter portion 112*d*.

The interior of the cylinder member 111 is divided into three spaces by the stepped piston 112 and the piston rings 113*a*, 113*b*. In more detail, the space in the small diameter portion 111*c* of the cylinder member 111 is defined as a small space 117 by the small diameter portion 112*c* of the stepped piston 112 and the small diameter piston ring 113*a*. The space of the large diameter portion 111*d* of the cylinder member 113 is divided into two by the large diameter portion 112*d* of she stepped piston 112 and the large diameter piston rind 113*b*. The lower side of the divided space is defined as a large diameter space 116. The upper side of the divided space (the space between the large diameter space 116 and the small space 117) is defined as a ring space 118 formed as a ring shape by the small diameter portion 1120 of the stepped piston 112.

One end surface (a large end surface) 111*a* of the cylinder member 111 is connected with one end of the passage 62. The other end of the passage 62 is connected with the pulse tube 33 via the radiator 34 in the cryocooler 30. Since the end portion 111*a* of the cylinder member 111 is a part of the wall surface surrounding the large space 116, the large space 116 is connected with the interior of the pulse tube 33 through the passage 62 and the radiator 34.

The other end surface (a small diameter end surface) 111*b* of the cylinder member 111 is connected with one end of the passage 63. The passage 63 is branched, and the branched ends are connected with the second high pressure on-off valve 23 and the second low pressure on-off valve 24, respectively. Since the other end portion 11*b* of the cylinder member 111 is a part of the wall surface surrounding the small space 117, the small space 117 is connected with the second high pressure on-off valve 23 and the second low pressure on-off valve 24 through the passage 63.

The ring space 118, which is one of the inner spaces defined in the cylinder member 111, is connected with one end of a passage 68. The other end of the passage 68 is connected with the passage 61. Accordingly, the ring space 118 connects with the cryocooler 30 via the passages 68 and 61.

In the pulse tube refrigerator 105, the timewise on-off controlling operations of each on-off valve 21, 22, 23, 24 and 25 when the refrigerator 105 is in operation, the pressure condition in the cold end 33*a* of the pulse tube 33 based on the timewise on-off controlling operations, and the timewise displacement of the stepped piston 112 in the cylinder member 111 are the same as in the FIG. 2 explained in the first embodiment. Since each process during operation is also the same as in the first embodiment, a detailed explanation of these processes is omitted.

In the high pressure transmitting process (3) (in the area of (3) in FIG. 2), the stepped piston 112 moves in the Y direction. Accordingly, the volume of the ring space 118 is decreased and the operating gas is pushed out. The operating gas flows into the cryocooler 30 through the passages 68, 61 and the cryocooler 30 and is compressed. In brief, the movement of the stepped piston 112 serves as the compression work in the cryocooler 30, which is supposed to be the role of the compressor 10. In the low pressure transmitting process (6) (in the area of (6) in FIG. 2), the stepped piston 112 moves in the X direction. Accordingly, the volume of the ring space 118 is increased. The operating gas in the cryocooler 30 is drawn into the cryocooler 30 through the passages 61, 68 and the cryocooler 30 and is expanded. In brief, the movement of the stepped piston 112 serves as the expansion work in the cryocooler 30, which is supposed to be the role of the compressor 10.

The heat generated by these operations is emitted in the pulse tube refrigerator 101 in the first embodiment, whereas the compressing or expanding operation occurs in the cryocooler 30 in the fifth embodiment. This helps the compressor 10, and so the work of the compressor 10 is decreased. As a result, the refrigeration efficiency can be improved.

The pulse tube refrigerator of the fifth embodiment includes the operation effect explained in the first embodiment. In addition, the piston 112 divides the interior of the cylinder member 111 into the first space (the large diameter space 116) connected with the inner space of the pulse tube 33, the second space (the small diameter space 117) connected with the second high pressure on-off valve 23 and the second low pressure on-off valve 24, and the third space (the ring space 118) connected with the regenerator 31 through the passages 68, 61. By providing the third space (the ring space 118) according to the movement of the piston 112, heat that would otherwise be emitted can be returned to the regenerator. Since the work of the compressor 10 is decreased, the refrigeration efficiency is improved.

Sixth Embodiment

Figure 8:
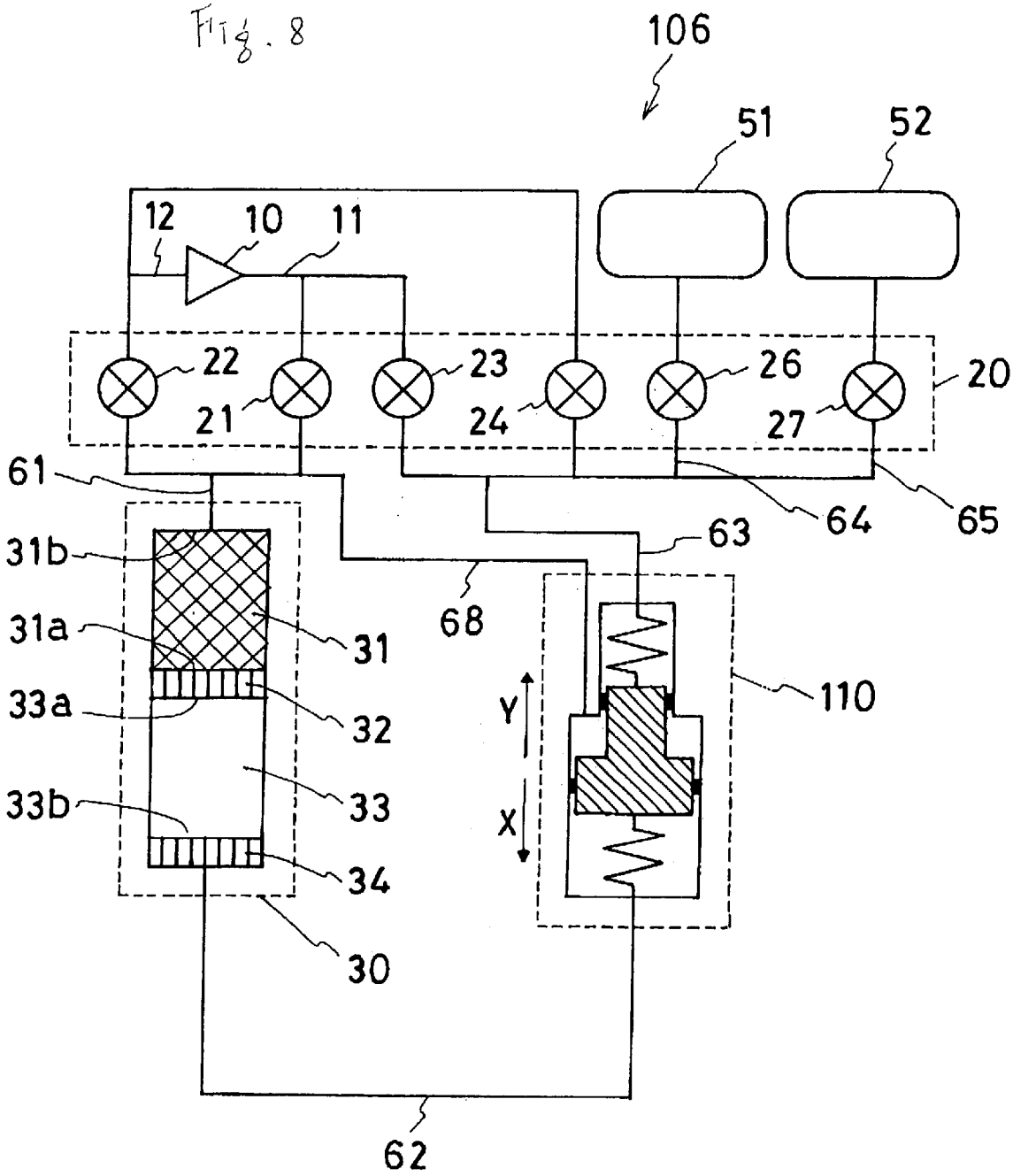
FIG. 8 is a schematic illustration of a pulse tube refrigerator of a sixth embodiment of the present invention.

FIG. 8 is a whole schematic illustration of a pulse tube refrigerator of the sixth embodiment of the invention. The basic structure of a pulse tube refrigerator 106 in FIG. 8 is the same as the pulse tube refrigerator 105 of the fifth embodiment in FIG. 7, and comprises two buffer tanks. The pulse tube refrigerator 106 adapts another tank to the pulse tube refrigerator 105. Since the other structure is the same as in the second or fifth embodiment, the same reference numbers refer to the same elements, and the explanation will be omitted.

In the pulse tube refrigerator 106, the timewise on-off controlling operations when the refrigerator is in operation, the pressure condition of the operating gas in the cold end of the first and second pulse tubes based on the timewise on-off controlling operations, and the timewise displacement of the stepped piston in the cylinder member are the same as in FIG. 4 explained in the second embodiment. Since each process during operation is also the same as in the second embodiment, a detailed explanation of these processes is omitted.

The pulse tube refrigerator of the sixth embodiment includes the operation effect explained in the second and fifth embodiments.

Seventh Embodiment

Figure 9:
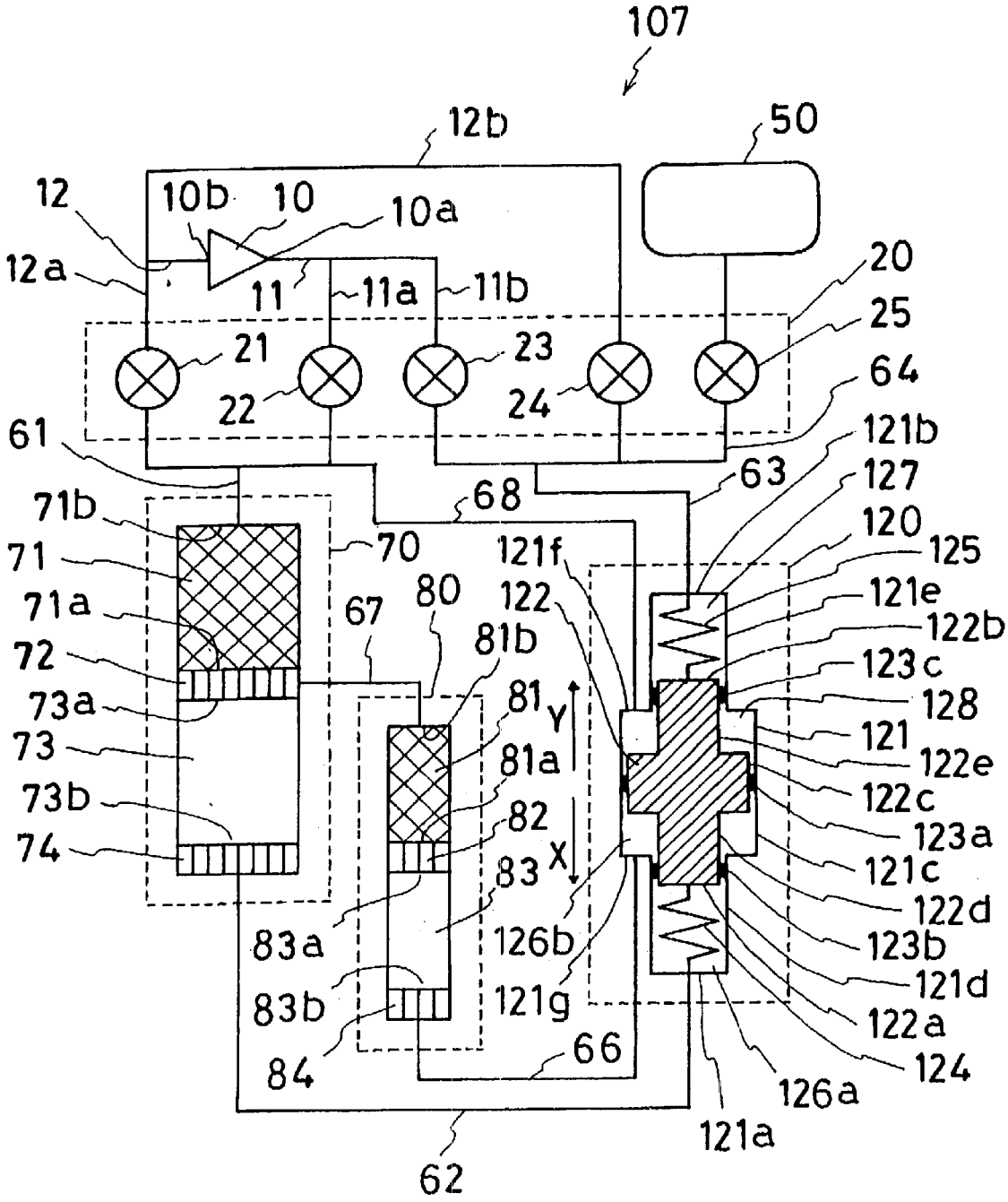
FIG. 9 is a schematic illustration of a pulse tube refrigerator of a seventh embodiment of the present invention.

FIG. 9 is a whole schematic illustration of a pulse tube refrigerator of the seventh embodiment of the invention. A pulse tube refrigerator 107 in FIG. 9 is a two stage pulse tube refrigerator in which the efficiency of the compressor is improved by the movement of the piston explained in the fifth embodiment. The structure of the compressor, the valve unit and the buffer tank are the same as in the fifth embodiment. The structure of the cryocooler is the same as in the third embodiment. Accordingly, the same reference numbers refer to the same elements in the pulse tube refrigerator in FIG. 1, and the explanation thereof will be omitted. Mainly, the differences will be explained hereinafter.

In FIG. 9, the pulse tube refrigerator 107 is provided with a fluid shield 120. The fluid shield 120 is provided with a cylinder member 121, a stepped piston 122, a large diameter piston ring 123*a*, a first small diameter piston ring 123*b*, a second small diameter piston ring 123*c*, a first spring 124 and a second spring 125. The cylinder member 121 has a large diameter portion 121*c*, a first small diameter portion 121*d* and a second small diameter portion 121*e*, and has a stepped cylindrical shape. The stepped piston 122 has a large diameter portion 122*c*, a first small diameter portion 122*d* and a second small diameter portion 122*e*, and has a stepped cylindrical shape. The large diameter piston ring 123*a* is attached on the outer periphery of the large diameter portion 122*c*, the first small diameter piston ring 123*b* is attached on the outer periphery of the first small diameter portion 122*d* and the second small diameter piston ring 123*c* is attached on the outer periphery of the second small diameter portion 122*e*.

The interior of the cylinder member 121 is divided into four spaces by the stepped piston 122 and the piston rings 123*a*, 123*b*, 123*c*. In more detail, the space in the first small diameter portion 121*d* of the cylinder member 121 is defined as a first small diameter space 126*a* by the first small diameter portion 122*d* of the stepped piston 122 and the first small diameter piston ring 123*b*. The space in the second small diameter portion 121*e* of the cylinder member 121 is defined as a second small diameter space 127 by the second small diameter portion 122*e* of the stepped piston 122 and the second small diameter piston ring 123*c*. The space in the large diameter portion 121*c* of the cylinder member 121 is divided into two by the large diameter portion 122*c* of the stepped piston 122 and the large diameter piston ring 123*a*. The upper side of the divided space is defined as a first ring space 128 formed as a ring shape by the second small diameter portion 121*e* of the stepped piston 122. The lower side of the divided space is defined as a second ring space 126*b* formed as a ring shape by the first small diameter portion 122*d* of the stepped piston 122.

One end surface (a first small end surface) 121*a* of the cylinder member 121 is connected with one end of the passage 62. The other end of the passage 62 is connected with the first pulse tube 73 via the first radiator 74 in the first cryocooler 70. A second stepped surface 121*g* is connected with one end of the passage 66. The other end of the passage 66 is connected with the second pulse tube 83 via the second radiator 84 in the second cryocooler 80. Since the end portion 121 a of the cylinder member 121 is a part of the wall surface surrounding the first small space 126*a*, the first small space 126*a* is connected with the inner space of the first pulse tube 73 through the passage 62 and the first radiator 74. Similarly, since the second stepped surface 121*g* of the cylinder member 121 is a part of the wall surface surrounding the second ring space 126*b*, the second ring space 126*b* is connected with the inner space of the second pulse tube 83 through the passage 66 and the second radiator 84.

The other end surface 121*b* of the cylinder member 121 is connected with one end of the passage 63. The passage 63 is branched, and the branched ends of the passage 63 are connected with the second high pressure on-off valve 23 and the second low pressure on-off valve 24, respectively. Since the other end portion 121*b* of the cylinder member 121 is a part of the wall surface surrounding the second diameter space 127, the second diameter space 127 is connected with the second high pressure on-off valve 23 and the second low pressure on-off valve 24 through the passage 63.

The first spring 124 is disposed in the first small space 126*a*. One end of the first spring 124 is fixed to a small diameter end surface 122*a* of the stepped piston 122, and the other end is fixed to the inner wall of the end surface 121*a* of the cylinder member 121. The second spring 125 is disposed in the second small diameter space 127. One end of the second spring 125 is fixed to the small diameter end portion 122*b* of the stepped piston 122, and the other end is fixed to the other end surface 121*b* of the cylinder member 121.

The first ring space 128 as one of the inner spaces defined by the cylinder member 111 is connected with the end of the passage 68. The other end of the passage 68 is connected with the passage 62.

In the pulse tube refrigerator 107, the timewise on-off controlling operations of each on-off valve 21, 22, 23, 24 and 25 when the refrigerator 103 is in operation, the pressure condition of the operating gas in a cold end 73*a* of the first pulse tube 73 and the pressure condition of the operating gas in the cold end 83*a* of the second pulse tube 83 based on the timewise on-off controlling operations, and the displacement of the stepped piston 122 in the cylinder member 121 in accordance with the time passing are the same as in FIG. 2 explained in the first embodiment. Since each process in operation is also the same as in the first embodiment, a detailed explanation of these processes is omitted.

In the pulse tube refrigerator 107, the cryogenic temperature of 4K can be generated in the second cryocooler 80 by providing two-stage cryocoolers. The first ring space 128 in the cylinder member 121 is connected with the first cryocooler 70 through the passage 68. Similarly to the sixth embodiment, the operation of the compressor is helped by the movement of the stepped piston 122. Since the work from the compressor is decreased, the refrigeration efficiency can be improved.

The pulse tube refrigerator of the seventh embodiment includes the operation effect explained in the first, third and fifth embodiments.

Eighth Embodiment

Figure 10:
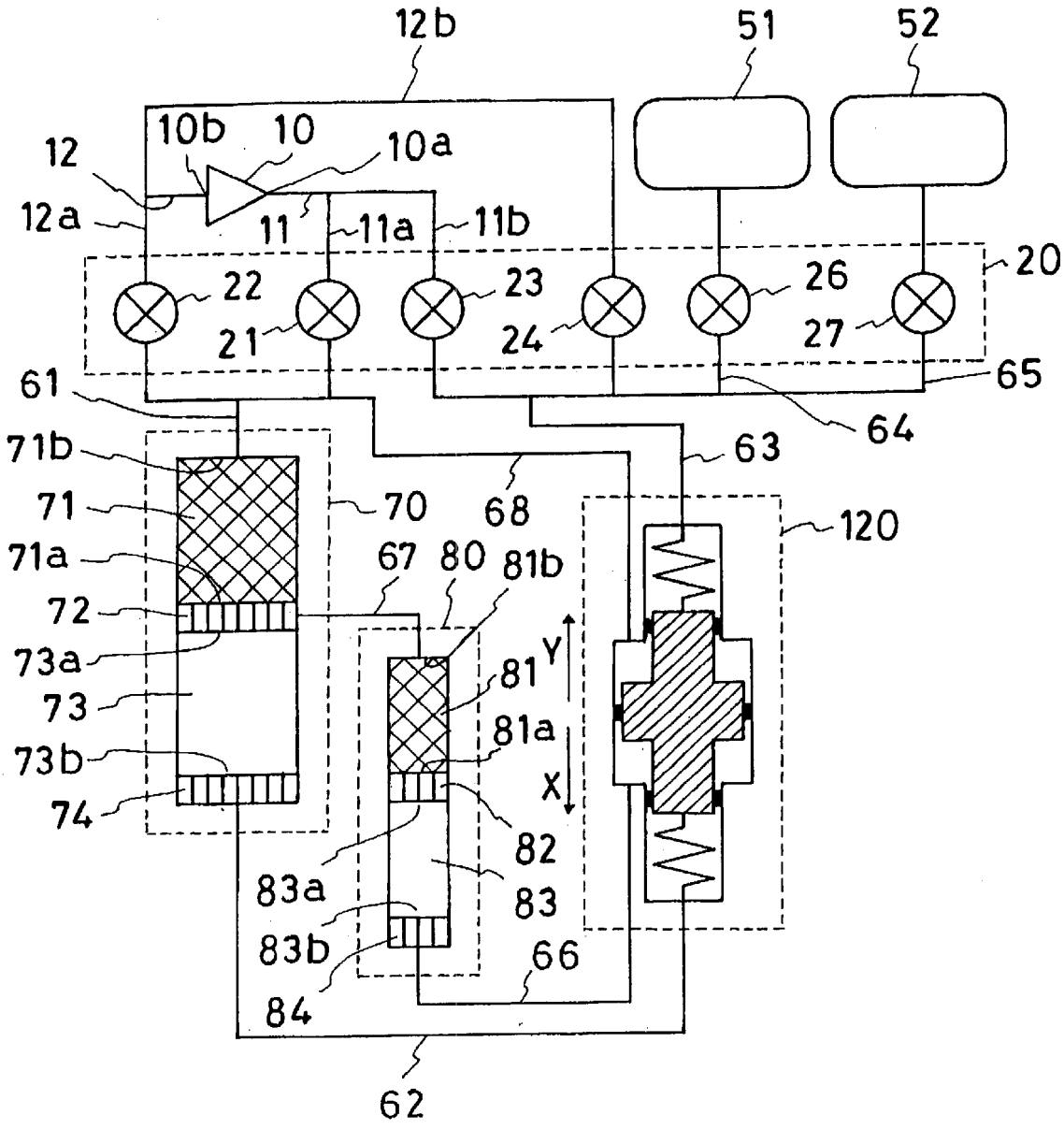
FIG. 10 is a schematic illustration of a pulse tube refrigerator of a eighth embodiment of the present invention.
Figure 11:
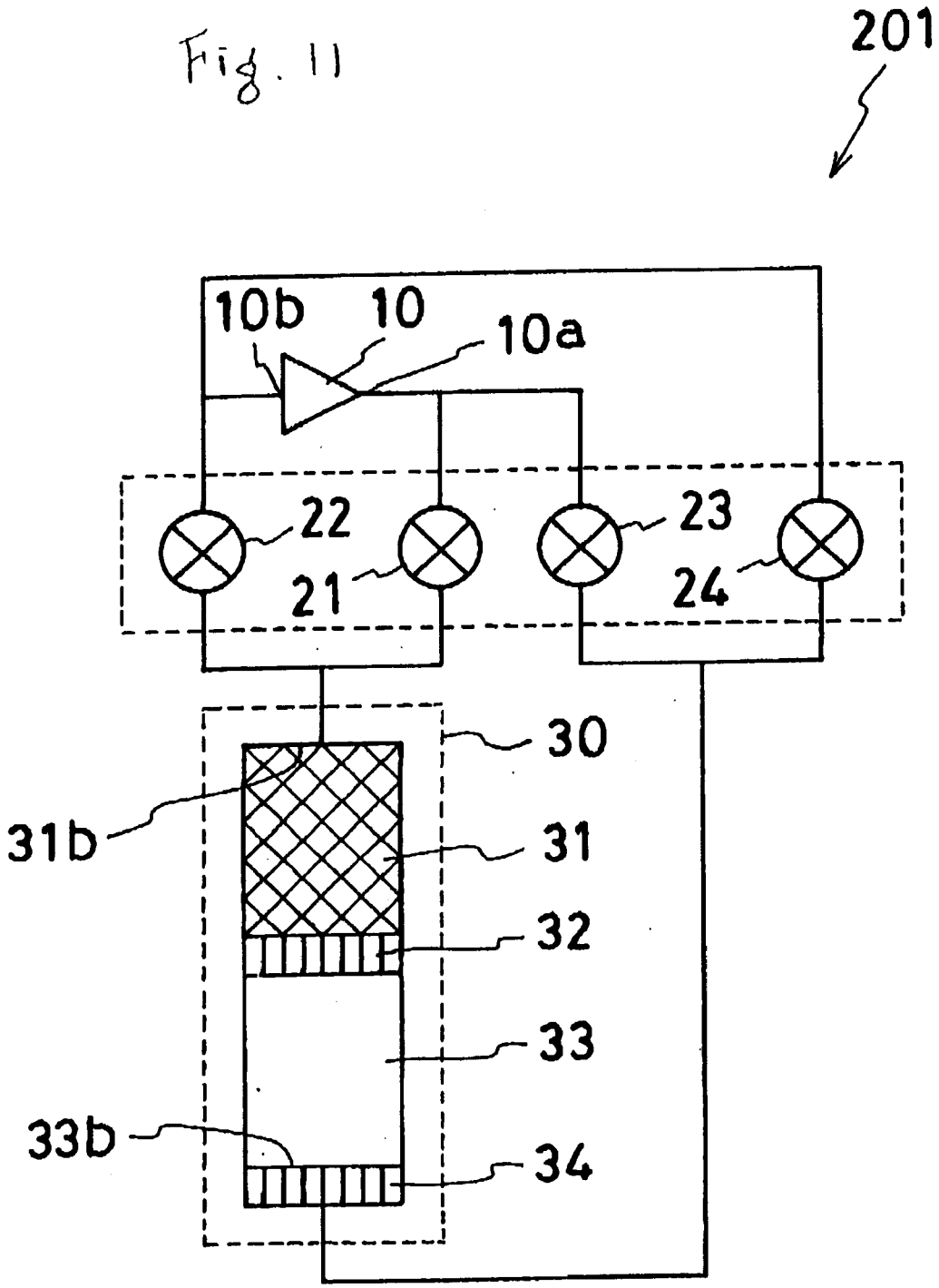
FIG. 11 is a schematic illustration of a conventional four valve type pulse tube refrigerator.
Figure 12:
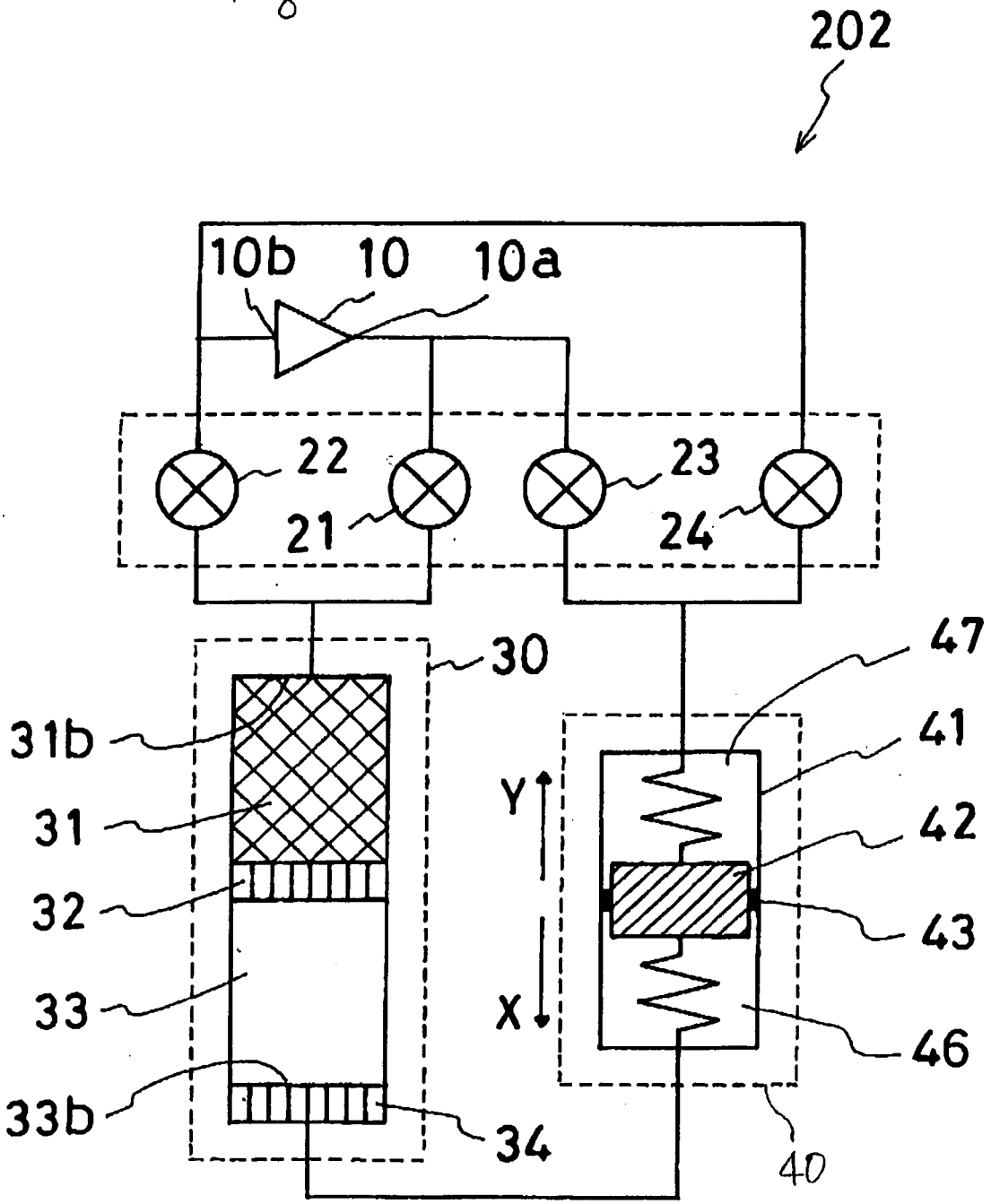
FIG. 12 is a schematic illustration of an improved conventional four valve type pulse tube refrigerator.

FIG. 10 is a whole schematic illustration of a pulse tube refrigerator of the eighth embodiment of the invention. The basic structure of a pulse tube refrigerator 108 in FIG. 10 is the same as the pulse tube refrigerator 107 of the seventh embodiment in FIG. 9. The pulse tube refrigerator 108 further comprises two buffer tanks. The pulse tube refrigerator 108 adapts another tank to the pulse tube refrigerator 107 explained in the second embodiment. Since the structure is the same as the second or seventh embodiment, the same reference numbers refer to the same elements, and the explanation will be omitted.

In the pulse tube refrigerator 108, the timewise on-off controlling operations when the refrigerator is in operation, the pressure condition of the operating gas in the cold end of the first and second pulse tubes based on the timewise on-off controlling operations, and the timewise displacement of the stepped piston in the cylinder member are the same as the FIG. 4 explained in the second embodiment. Since each process when in operation is also the same as the second embodiment, a detailed explanation of these processes is omitted.

The pulse tube refrigerator of the eighth embodiment includes the operation effect explained in the first, second, third and fifth embodiments.

What we claim is:

1. A pulse tube refrigerator comprising:

a compressor;

a first high pressure on-off valve and a second high pressure on-off valve connected with a high pressure outlet port of the compressor;

a first low pressure on-off valve and a second low pressure on-off valve connected with a low pressure inlet port of the compressor;

a cryocooler comprising a regenerator, a cold head and a pulse tube arranged in series in line and connected with the first high pressure on-off valve and the first low pressure on-off valve at the regenerator;

a cylinder member connected with the pulse tube at one end, and connected with the second high pressure on-off valve and the second low pressure on-off valve at the other end;

a piston arranged in the cylinder member, the piston separating an interior of the cylinder into a first space connected with an inner space of the pulse tube and a second space connected with both the second high pressure on-off valve and the second low pressure on-off valve;

a buffer connected with the second space; and a buffer side on-off valve provided between the buffer and the second space.

2. A pulse tube refrigerator as set forth in claim 1, including a plurality of said buffers and a plurality of said buffer side on-off valves, wherein each said buffer side on-off valve is interposed between the second space and a respective buffer.

3. A pulse tube refrigerator as set forth in claim 1, including two of said buffers and two of said buffer side on-off valves, wherein each said buffer side on-off valve is interposed between the second space and a respective buffer.

4. A pulse tube refrigerator as set forth in claim 1, wherein the cryocooler includes a first cryocooler comprising a first regenerator, a first cold head and a first pulse tube arranged in series in line, the first regenerator being connected with the first high pressure on-off valve and the first low pressure on-off valve, and a second cryocooler comprising a second regenerator, a second cold head and a second pulse tube arranged in series in line, the first cold head being connected with the second regenerator.

5. A pulse tube refrigerator as set forth in claim 1, wherein an interior of the cylinder member is divided into at least three spaces by the piston, wherein the at least three spaces comprise a first space connected with an inner space of the pulse tube, a second space connected with both the second high pressure on-off valve and the second low pressure on-off valve, and a third space connected with the regenerator of the cryocooler.

6. A pulse tube refrigerator as set forth in claim 4, wherein an interior of the cylinder member is divided into at least three spaces by the piston, wherein the at least three spaces comprise a first space connected with an inner space of the first pulse tube, a second space connected with both the second high pressure on-off valve and the second low pressure on-off valve, and a third space connected with an inner space of the second pulse tube.

7. A pulse tube refrigerator as set forth in claim 6, wherein an interior of the cylinder member is divided into at least four spaces by the piston, wherein the at least four spaces comprise a first space connected with an inner space of the first pulse tube, a second space connected with both the second high pressure on-off valve and the second low pressure on-off valve, a third space connected with an inner space of the second pulse tube and a fourth space connected with the first regenerator of the first cryocooler.

8. A pulse tube refrigerator as set forth in claim 1, wherein the piston is elastically supported by an elastic element in the cylinder.

9. A pulse tube refrigerator as set forth in claim 8, wherein the elastic element is a spring.

10. A pulse tube refrigerator comprising:

a compressor;

a first high pressure on-off valve and a second high pressure on-off valve connected with a high pressure outlet port of the compressor;

a first low pressure on-off valve and a second low pressure on-off valve connected with a low pressure inlet port of the compressor;

a cryocooler comprising a regenerator, a cold head and a pulse tube arranged in series in line and connected with the first high pressure on-off valve and the first low pressure on-off valve at the regenerator;

a cylinder member connected with the pulse tube at one end, and connected with the second high pressure on-off valve and the second low pressure on-off valve at the other end;

a piston arranged in the cylinder member, the piston separating an interior of the cylinder into a first space connected with an inner space of the pulse tube and a second space connected with both the second high pressure on-off valve and the second low pressure on-off valve; and means for buffering a pressure of a gas in said second space.

11. A pulse tube refrigerator comprising:

a compressor;

a first high pressure on-off valve and a second high pressure on-off valve connected with a high pressure outlet port of the compressor;

a first low pressure on-off valve and a second low pressure on-off valve connected with a low pressure inlet port of the compressor;

a cryocooler comprising a regenerator, a cold head and a pulse tube arranged in series in line and connected with the first high pressure on-off valve and the first low pressure on-off valve at the regenerator;

means for isolating a gas in the cryocooler from the second high pressure on-off valve and the second low pressure on-off valve; and means for buffering a pressure of a gas at the second high pressure on-off valve and the second low pressure on-off valve.

12. A pulse tube refrigerator comprising:

a compressor;

a first high pressure on-off valve and a second high pressure on-off valve connected with a high pressure outlet port of the compressor;

a first low pressure on-off valve and a second low pressure on-off valve connected with a low pressure inlet port of the compressor;

a cryocooler connected with the first high pressure on-off valve and the first low pressure on-off valve;

means for isolating a gas in the cryocooler from the second high pressure on-off valve and the second low pressure on-off valve; and means for buffering a pressure of a gas at the second high pressure on-off valve and the second low pressure on-off valve.

* * * * *